US011610565B2

(12) United States Patent
Hildebrandt

(10) Patent No.: US 11,610,565 B2
(45) Date of Patent: Mar. 21, 2023

(54) TREMOLO DEVICE FOR ELECTRIC GUITARS

(71) Applicant: James Hildebrandt, Ormond (AU)

(72) Inventor: James Hildebrandt, Ormond (AU)

( * ) Notice: Subject to any disclaimer, the term of this patent is extended or adjusted under 35 U.S.C. 154(b) by 0 days.

(21) Appl. No.: 17/595,133

(22) PCT Filed: May 11, 2020

(86) PCT No.: PCT/AU2020/050463

§ 371 (c)(1),
(2) Date: Nov. 9, 2021

(87) PCT Pub. No.: WO2020/227764

PCT Pub. Date: Nov. 19, 2020

(65) Prior Publication Data

US 2022/0148541 A1 May 12, 2022

(30) Foreign Application Priority Data

May 10, 2019 (AU) ..... 2019901604

(51) Int. Cl.
*G10D 3/153* (2020.01)
*G10D 1/08* (2006.01)

(52) U.S. Cl.
CPC ..... *G10D 3/153* (2020.02); *G10D 1/085* (2013.01)

(58) Field of Classification Search
CPC ..... G10D 3/153; G10D 1/085
See application file for complete search history.

(56) References Cited

U.S. PATENT DOCUMENTS 2,741,146 A * 4/1956 Fender ..... G10D 3/153 84/740
3,326,072 A * 6/1967 Price ..... G10D 3/153 D17/14
4,572,049 A * 2/1986 Tanaka ..... G10D 3/153 84/297 R
4,608,905 A * 9/1986 Takabayashi ..... G10D 3/153 84/312 R
4,608,906 A * 9/1986 Takabayashi ..... G10D 3/153 84/312 R
4,674,389 A * 6/1987 Fender ..... G10D 3/153 84/267
4,939,971 A * 7/1990 Satoh ..... G10D 3/153 84/313

(Continued)

OTHER PUBLICATIONS

International Search Report and Written Opinion of the International Searching Authority; Application No. PCT/AU2020/050463; Completed: Jul. 10, 2020; dated Jul. 10, 2020; 13 Pages.

*Primary Examiner* — Robert W Horn
(74) *Attorney, Agent, or Firm* — Whitmyer IP Group LLC

(57) ABSTRACT

A tremolo device for electric guitars including: a) a tremolo mount resiliently mountable on a guitar body adjacent at least one string and the tremolo mount selectively moveable relative to the guitar body; b) a string mount mounted on the tremolo mount in order to receive an end of at least one string of a guitar and the string mount having separate limited movement to the selective movement of the tremolo mount and allow the at least one string to be tunably tensioned; wherein the resilient mounting of the tremolo mount is at least partially decoupled from the tensioned string held by the string mount.

19 Claims, 23 Drawing Sheets

(56) References Cited

U.S. PATENT DOCUMENTS

| | | | | | |
|---|---|---|---|---|---|
| 5,088,374 | A * | 2/1992 | Saijo | G10D 3/153 | 84/313 |
| 5,127,298 | A * | 7/1992 | Snape | G10D 3/153 | 84/313 |
| 5,551,329 | A * | 9/1996 | Iovane | G10D 3/153 | 84/313 |
| 5,672,835 | A * | 9/1997 | Doughty | G10D 3/153 | 84/313 |
| 7,718,873 | B1 * | 5/2010 | Slavik | G10D 3/153 | 84/312 R |
| 8,946,529 | B2 * | 2/2015 | Rose | G10D 1/08 | 84/313 |
| 10,380,977 | B1 * | 8/2019 | Rose | G10D 1/085 | |
| 2014/0165817 | A1 * | 6/2014 | Cadwell | G10D 3/153 | 84/313 |
| 2022/0148541 | A1 * | 5/2022 | Hildebrandt | G10D 1/085 | |

* cited by examiner

New Bridge Profile -Treble Side - Showing Handle

50

50

Hinge 3 – lever side

Hinge 3 – neutral

Hinge 3 – pitch up

Hinge 3 – pitch down

Hinge 4 – neutral

Hinge 4 – components

Hinge 4 – pitch up

Hinge 4 – pitch down

Hinge 5 – components

Hinge 5 – pitch up

Hinge 5 – pitch down

BASE PLATE

51

BRACKET

PITCH LEVER STOP

&

TENSION SPRING ATTACHMENT

53

PITCH LEVER

352

BASE PLATE - KNIFE EDGE

51

PITCH LEVER

52

BRACKET 3 ALTERNATIVES 53

COMMON HINGE / PIVOT 2

TREMOLO DEVICE FOR ELECTRIC GUITARS

TECHNICAL FIELD

The present invention relates to an improved tremolo device and in particular to an improved tremolo device for electric guitars. However, it will be appreciated that the invention is not limited to this particular field of use but could apply to other stringed instruments.

BACKGROUND

Clarence Leo Fender was an early developer of electric guitars in the 1950s. His name, Fender, is still today a major brand of guitars with a deep history.

Introduced in 1951, the Fender Telecaster was the world's first solid body electric guitar. At over 60 years old, it's been used in almost every genre of music from western swing to metal. The Fender Telecaster is the original Fender tone machine and work horse that simply never quits. It is considered an essential addition in any guitarist's toolkit.

In 1954 The Fender Stratocaster was introduced and patented under U.S. Pat. No. 2,741,146. The Stratocaster was the first guitar to feature three pickups and a spring tension vibrato or tremolo system, as well as being the first Fender with a contoured body. The Stratocaster's sleek, contoured body shape (officially referred to by Fender as the "Comfort Contour Body") differed from the flat, slab-like design of the Telecaster. The Stratocaster's double cutaways allowed players easier access to higher positions on the neck.

The concept of the tremolo system is to provide a pivoting bridge system with limited pivotal movement in order that the tension applied to the strings may be readily varied to produce a tremolo effect. In FIG. 2 this pivoting bridge system comprises a base that is pivotally connected by its own bridge pivot screw 61 on the top of the guitar body and connected rigidly perpendicularly to its own end tube 32 to extend into the that holds the end support 14 holding the end of the string. This is separately repeated for each string.

However, as shown in FIG. 2, to achieve this the Fender system had the effective operating length of each string 13 limited by its end support 14 and its height to be individually adjusted to facilitate proper tuning of each string without interfering with simultaneous tension variation of the several strings required to produce a tremolo effect.

This tremolo system of the prior art has been fairly consistent in construction since its inception. It has individual mountings of each string with string end mounts in a respective slot at the bottom of the spring bracket and where each string must be accessed within the transverse slot in the body of the guitar. However, access must be from the rear and against the tension of the strings. Therefore, if one string is broken installing a replacement string will need to be against the tension of the other strings and usually affects the other strings. Generally, therefore all strings need to be replaced or at least retuned. There also needs to be rebalancing between the strings.

It can be seen that known prior art an improved tremolo device for electric guitars has the problems of:

a) It is balanced between the string tension and spring tension it takes some skill and time to set it up
b) It is sensitive to string gauges—set-up for light gauges needs to be readjusted for heavy gauges c) The guitar is detuned if a single string breaks as the balance between strings and springs is upset—often the guitar needs full restringing and retuning (and sometimes readjusting).

SUMMARY

The present invention seeks to provide an improved tremolo device for electric guitars, which will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

According to a first aspect of the present invention, there is provided an improved tremolo device for electric guitars comprising a) a tremolo mount resiliently mountable on a guitar body adjacent at least one string and the tremolo mount selectively moveable relative to the guitar body;
b) a string mount mounted on the tremolo mount in order to receive an end of at least one string of a guitar and the string mount having separate limited movement to the selective movement of the tremolo mount and allow the at least one string to be tunably tensioned;

wherein the resilient mounting of the tremolo mount is at least partially decoupled from the tensioned string held by the string mount.

The selectively moveable tremolo mount is by a manual means. The selectively moveable string mount is by a manual means. Preferably the selectively moveable tremolo mount the selectively moveable string mount is by a single manual means wherein the manual means is a tremolo handle providing leverage on the tremolo device against the resilient mounting and the tensioned strings.

In one form the improved tremolo device for electric guitars includes a primary pivotal mount wherein in use the primary pivotal mount is resiliently held towards an extended string position but is selectively manually moveable to a less than extended string position.

The primary pivotal mount is pivotal on an upper side of the body.

Preferably the primary pivotal mount is resiliently held towards an extended string position by a tension spring mounted to a lower part of the body the guitar.

Also in a preferred form of the improved tremolo device for electric guitars the string mount includes a secondary pivotal mount mounted on the primary pivotal mount; and the secondary pivotal mount includes string end mounts for holding the ends of the strings distal from the ends of the strings held by rotatable tuning keys on a top side of the head such that the strings stretch along an elongated neck between the head and the body and over a saddle of a bridge to the string end mounts.

Most preferably the string end mounts for holding the ends of the strings are located on an upper side of the secondary pivotal mount relative to the pivotal mount on the primary pivotal mount wherein in use the string ends are accessible above the top surface of the body of the guitar without disassembly or access to the slot in the body of the guitar.

The structure provides:

a) the primary pivotal mount is directly held towards an extended string position by a tension spring mounted to a lower part of the body the guitar;

b) the primary pivotal mount is indirectly held by a tensioned string position;

c) the secondary pivotal mount is indirectly held by a tensioned string position;

d) the secondary pivotal mount is indirectly limited towards an extended string position by the tension spring mounted to a lower part of the body the guitar and limited by the interaction of the primary mount and the secondary mount and the body of the guitar;

e) and wherein the primary pivotal mount and secondary pivotal mount is selectively moveable by the manual means of a tremolo handle providing leverage on the tremolo device against the resilient mounting and the tensioned strings to vary tension of the strings and provide a tremolo effect.

The interaction of the primary mount and the secondary mount and the body of the guitar provide limitations of relative pivoting against the resilient mounting of the tremolo mount which is at least partially decoupled from the tensioned string held by the string mount to provide a) Primary pivotal mount pivotable from adjacently parallel to the top surface of the body of the guitar to away from the top surface;

b) Secondary pivotal mount pivotable on the primary pivotal mount from a tensioned string position to a less tensioned string position; and c) Secondary pivotal mount pivotable on the primary pivotal mount from a tensioned string position to a more tensioned string position.

In a preferred form the primary pivotal mount includes a base plate mounted at one end to the upper surface of the body and that overlies a slot in the body wherein pivoting is restricted between the base plate being adjacently planar with the body and pivoting away from the upper surface of the body.

The primary pivotal mount can include a stop plate attached to and extending from an underside of the base plate and in use extending into the slot in the body wherein pivoting is resiliently held towards an extended string position by a tension spring mounted between a lower part of the stop plate and a lower part of the body the guitar.

The string mount can include a pitch lever plate pivotally mounted on the base plate of the tremolo mount with string end mounts for holding the ends of the strings are located on an upper side of the secondary pivotal mount relative to the pivotal mount and pitch lever plate in use extending into the slot of the body alongside the stop plate and selectively engageable therewith.

Selective engagement is by engagement elements formed at a lower level of the stop plate and the pitch lever plate.

The pitch lever plate can include a crank shape which lower level engages with lower level of the stop plate at a resting tensioned spring position.

Preferably the pitch lever plate includes a crank shape with a cutaway sized such as to receive the stop plate therethrough and have a lower part of the crank shaped pitch lever plate on one side of the stop plate and the upper part of the crank shaped pitch lever plate including the pivot on the other side of the stop plate wherein rotation caused by the tensioned string is stopped by lower part of the crank shaped pitch lever plate engaging the one side of the stop plate.

The selectively moveable tremolo mount and the selectively moveable string mount is by a single manual means of a tremolo lever mounted to the pitch lever plate of the secondary pivotal mount.

The improved tremolo device for electric guitars can include a string intonation adjustor mounted on the tremolo mount and having a string engaging protuberance for providing a selectively adjustable moveable engagement to the string to fine tune the string intonation.

In another form of the invention there is provided a method of providing an improved tremolo device for electric guitars including the steps of:

a) providing a primary pivotal mount that is resiliently held towards an extended string position;

b) providing a secondary pivotal mount mounted on the primary pivotal mount wherein the resilient mounting of the tremolo mount is at least partially decoupled from the tensioned string mount.

The secondary pivotal mount is preferably mounted on the primary pivotal mount and for limiting the interaction of the primary mount and the secondary mount and the body of the guitar wherein the resilient mounting of the tremolo mount is at least partially decoupled from the tensioned string held by the string mount and effectively provides three main differences of operation.

A first mode of operation there is the conditions of:

a) The tension spring resiliently pivots the base plate to a closed position over the transverse slot;

b) The tremolo lever is not activated in a balanced position; and c) The pitch lever plate is in a balanced position.

wherein at this point the tension of the strings is in a fixed tunable position similar to a guitar without a tremolo device.

A second mode of operation there is the conditions of:

a) The tension spring resiliently pivots the base plate towards a closed position over the transverse slot;

b) The tremolo lever is activated in a forward position and pivots the pitch lever plate forward around secondary pivot; and c) The top of the pitch lever plate is moved forward but only till the bottom of the pitch lever plate engages the stop bracket and pivots the base plate open around primary pivot against the resilience of the tension spring;

wherein at this point the string end mount is moved forward and the tension of the strings is reduced from the fixed tunable position to provide a variation of pitch and a tremolo effect.

A third mode of operation there is the conditions of:

a) The tension spring resiliently pivots the base plate to a closed position over the transverse slot;

b) The tremolo lever is activated in a backward position but no longer against any resilience of the tension spring as the base plate has engaged the body on both sides of the transverse slot and can no longer pivot further around primary pivot; and c) The pitch lever plate is in a balanced position.

wherein at this point the string end mount is moved backwards and the tension of the strings is increased from the fixed tunable position to provide a variation of pitch and a tremolo effect.

It can be seen that the invention of an improved tremolo device for electric guitars provides the benefit of decoupling. Further it can be seen that the invention of an improved tremolo device for electric guitars provides the benefit of making the bridge easier and simpler to maintain.

The improved tremolo device for electric guitars can be substantially assembled with improved benefits including any one or more of the following:

i. Improvements in structure and assembly including construction in order to minimise complexity ii. Improvements in better construction to provide increased useability and less dependence on professional repair and maintenance;

iii. Improvements in accessibility when in use;

iv. Improvements in tunability;

v. Improvements in ease of change of strings;

vi. Improvements in lessening loss of tunability of other strings; and vii. Improvements in adaptability to different gauge strings.

It can be seen that the invention of the improved tremolo device for electric guitars provides the benefit of allowing the guitarist to maintain and alter and change strings themselves without external experts.

Other aspects of the invention are also disclosed.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

DETAILED DESCRIPTION

Figure 1:
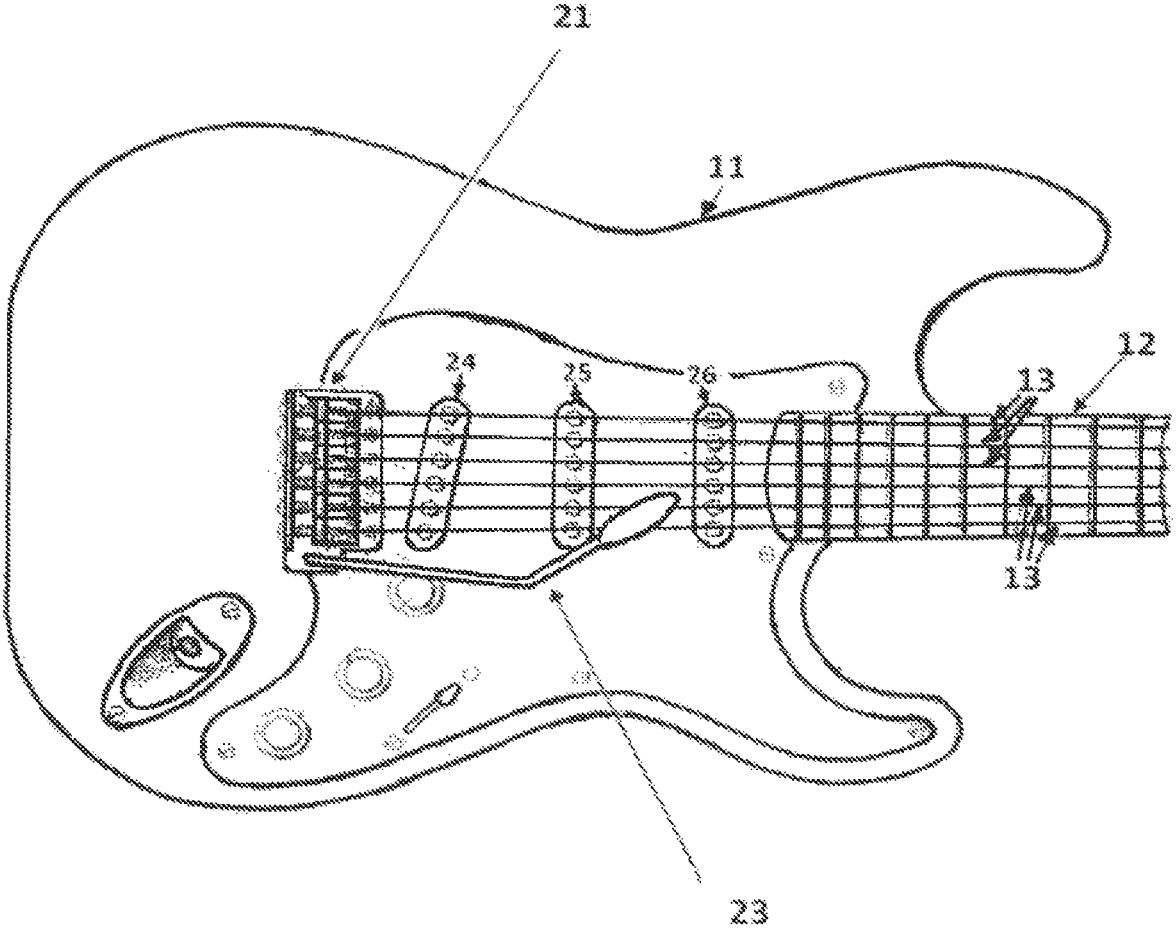
FIG. 1 is a diagrammatic front view of a Fender Stratocaster which can be installed with a tremolo device in accordance with a preferred embodiment of the present invention.

It should be noted in the following description that like or the same reference numerals in different embodiments denote the same or similar features.

The synchronized guitar tremolo is used by a musician to raise or lower the note pitch of the strings of a guitar during a performance to produce an artistic musical effect.

The synchronized guitar tremolo enables the performer to increase or decrease the overall string tension of a guitar to produce a choral effect as the note pitch of the strings is increased or decreased.

The most widely used synchronized tremolo is that of the Fender Stratocaster which employs a balanced, or floating bridge design that pivots at the leading edge of the bridge plate. The string tension is precisely counter-balanced by the attachment to the bridge of a number of tension springs within and connected to the body of the guitar.

When the bridge is adjusted for tremolo use the strings are tuned and the spring tension adjusted so that the bridge sits at an angle to the upper surface of the guitar, balanced at a desired neutral position on the forward pivot by the two opposing tension forces of strings and springs.

By the use of a handle attached to the bridge assembly the musician may control the pitch of the strings by rotating the bridge assembly upwards, away from the guitar body to lessen string tension; or downwards, towards the guitar body to increase string tension.

The advantage of this balanced design is in its sensitivity, as raising or lowering string tension takes little effort on the part of the musician.

The inherent disadvantage is that the tuning depends on the system remaining balanced. When a string breaks, the tension springs become the dominant force and the other strings are detuned. The instrument becomes unplayable and must be withdrawn from service to have the broken string replaced, retuned, and the bridge balance re-adjusted.

The improved tremolo bridge is designed to overcome this defect by separating the functions of increasing and decreasing string tension. It directly replaces the existing tremolo to provide a simple and effective solution to the problem of detuning caused by string breakage.

It does this by:

(a) leaving the existing tension strings in place and attached to the new bridge assembly, adjusted so as to swamp the tension force exerted by the tuned strings and hold the bridge to the surface of the guitar. This approach ensures that the breakage of one or more strings does not affect the tuning of the unbroken strings.

(b) introducing a second pivot at the rear of the bridge with a separately movable lever that the strings attach to, so designed that string tension may be increased; but not decreased; by the lever alone if a rise in pitch is desired.

(c) decreasing pitch by using the lever to move the entire bridge against the force exerted by the tension springs so as to raise the assembly above the surface of the guitar and decrease string tension.

Figure 4:
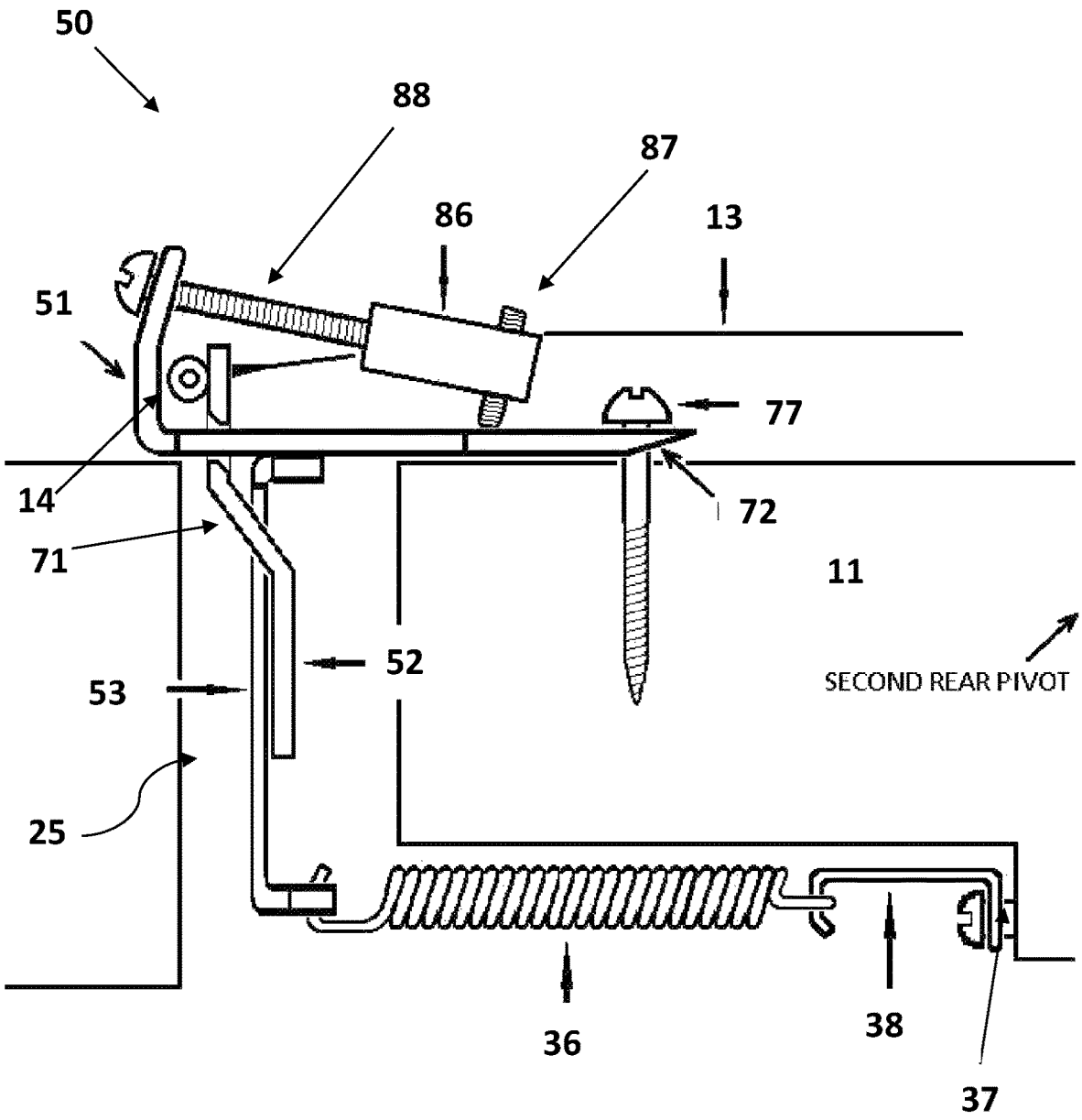
FIG. 4 is a diagrammatic is a diagrammatic sectional view along the longitudinal axis of the of the Fender Stratocaster of FIG. 1 showing the tremolo device of a preferred embodiment of the present invention in functional position and interaction with strings and body of the guitar in accordance with a preferred embodiment of the present invention.
Figure 5:
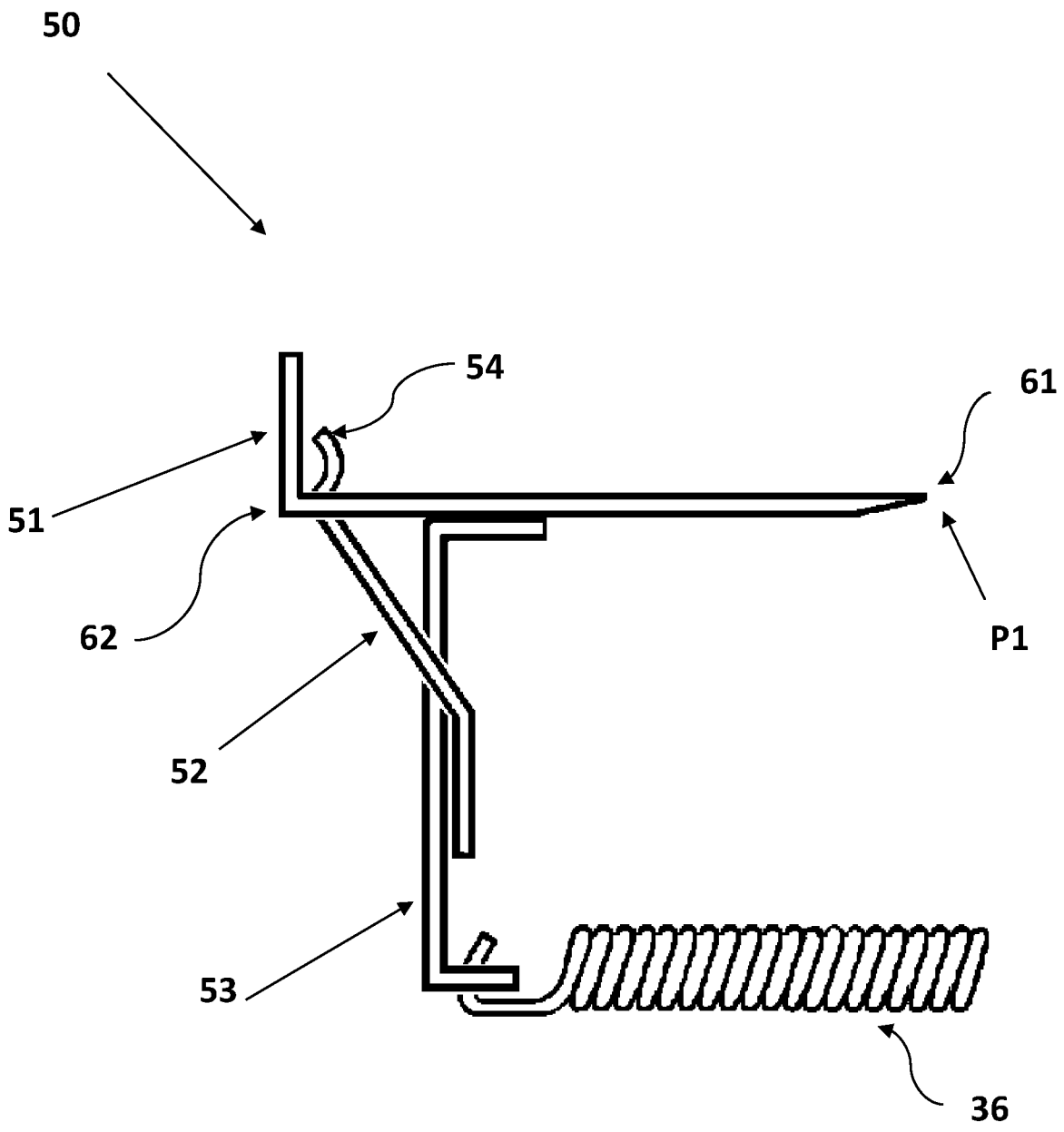
FIG. 5 is a diagrammatic component sectional views along the longitudinal axis of basics of the tremolo device of the Fender Stratocaster such as of FIG. 4 of the present invention showing cross sectional separate components of base plate, pitch lever and stop and spring brackets of the tremolo device.
Figures 6, 7:
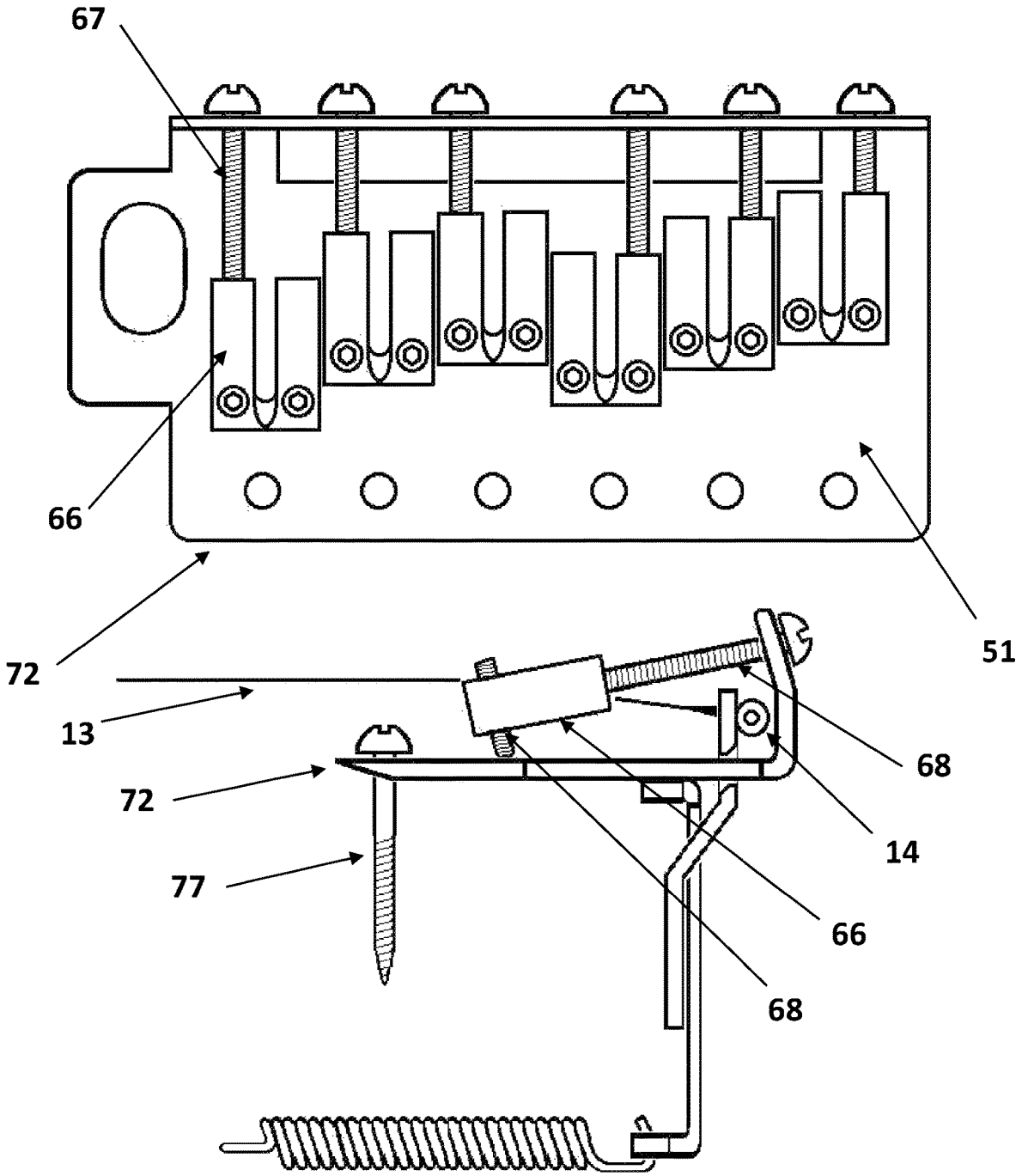
FIG. 6 is an overhead plan view of a base plate with multiple saddles mounted thereon for screw adjustment and FIG. 7 is a diagrammatic cross-sectional view showing the base plate and saddle in actionable position and FIG. 8 is showing the opposite side cross sectional view with handle and attachment for user operational tremolo control in accordance with an embodiment of the invention.

Referring to the drawings and particularly FIGS. 4, 5 and 6 there is shown the tremolo device 50 of the invention for use with the guitar 10 of FIG. 1 instead of the known tremolo device 21. The guitar 10 has a body 11, which is preferably solid, and an elongated neck 12 extending therefrom to a head (not shown). The strings 13 are held and extend from offset rotatable tuning keys (not shown) on a top side of the head and stretch along the neck 12 and over the body 11 and over a bridge to a string end mount. The strings 13 can thereby be tensioned separately and tuned separately by rotation of the tuning keys on the head.

Along the body 12 under the strings 13 are three pickups 24, 25 and 26 for picking up the vibration caused by the guitarist plucking the tensioned strings. Also, the length of string can be effectively altered by the guitarist causing engagement of a string with one of the fret bars extending at predefined spaced positions across the neck 12. The differing vibrations by different effective lengths form different musical notes or chords which can then be received by the pickups for electric amplification.

The complication of the prior art form of tremolo is that the one tremolo action affects the plurality of end portions of the strings but the strings need to be separately tuned as they are individually mounted.

Instead of a simple string end mount to hold the lower end of the strings 13 the present invention provides a tremolo device 21 with a tremolo lever 23. The basis of the tremolo device is to provide a general change of effective length of the strings or variation of the tensioning of the strings to provide variations around a note and thereby a tremolo effect.

The tremolo device 50 fits in and over a transverse slot 25 in the body 11 of the guitar 10. This transverse slot 27 extends to a longitudinal slot 28 at the back of the body 11 of the guitar 10 and is closed by a backing plate 29.

Figure 2:
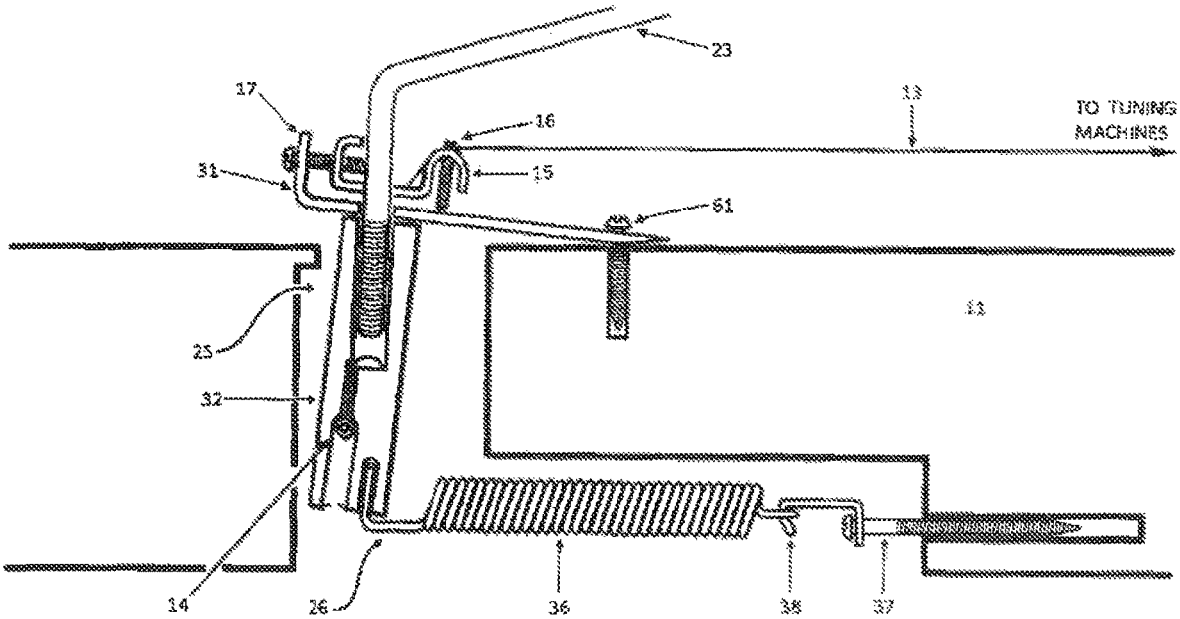
FIGURE 2 Prior Art
FIGS. 2 and 3 are left and right side diagrammatic sectional views along the longitudinal axis of the of the Fender Stratocaster of FIG. 1 showing the tremolo device of the prior art.
Figure 3:
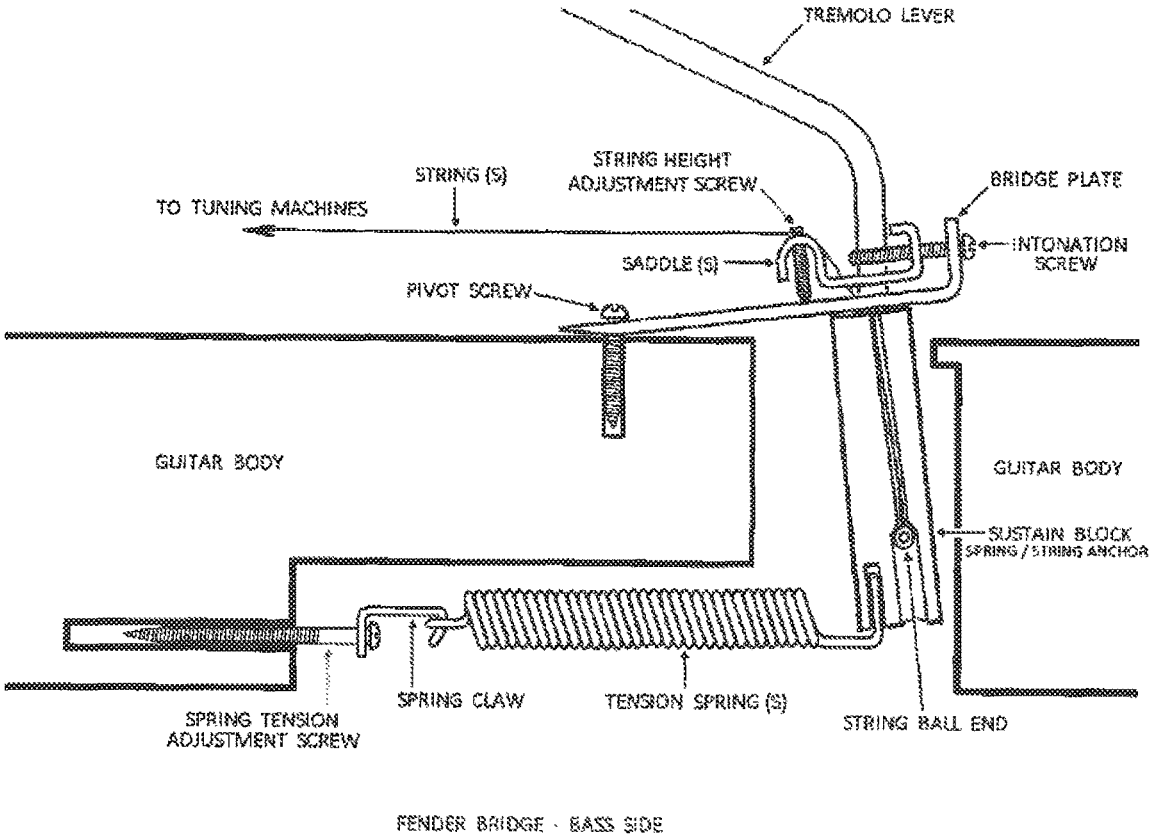
FIGURE 3 Prior Art

In the tremolo device of the prior art of FIGS. 2 and 3 the tremolo device consists of two parts. The first part 31 is a base plate that extends over the transverse slot 25 and is pivotally mounted at one side at bridge pivot 61. A second part is a spring bracket 32 which is connected underneath to the base plate 31 and extends within the transverse slot 27 to the longitudinal slot 28 at the back of the body 11 and which is closed by backing plate 29. Within the longitudinal slot is a tension spring 36 that engages the bottom of the spring bracket 32.

It can be seen that the strings 13 extend from the offset rotatable tuning keys (not shown) on a top side of the head and stretch along the neck 12 and over the body 11 and over the saddle 15 of a bridge to a string end mount 14 in a slot at the bottom of the spring bracket 32.

The strings are therefore tensioned and by levering of the tremolo lever 23 the base plate 31 pivots around the bridge pivot 61 against the tension of the tension spring connected in the longitudinal slot 26 between the body 11 and the base of the spring bracket.

It can be seen therefore that the tension of the strings is in opposition to the tension of the tension spring 36. Further the end mount 14 of the strings 13 is in the body 11 in the transverse slot 25 in a difficult position to access. Generally, therefore any replacement string or tuning or change of gauge of strings requires full disassembly and change of all strings before full reassembly back into the difficult confined position. Even then in use the conflict between the tension of the strings and the tension spring provides difficulty in obtaining controlled tremolo effect.

In the tremolo device 50 of the invention and referring to FIGS. 4, 5 and 6 there is shown a particular preferred form of the tremolo device 50 of the invention which is formed of three parts.

The simplest form of the improved tremolo bridge is constructed from five separate components:

a) A Base Plate 51 providing a foundation for other components and to attach the complete assembly to the upper surface of the guitar.

b) A Bracket, acting as a stop bracket 52, that attaches to the underside of the base plate.

c) A Pitch Lever 53 located at the rear of the bridge assembly.

d) A Handle or tremolo lever 23 which attaches to the pitch lever.

e) A Bridge or saddle 66 over which the strings pass to the tuning machines.

Base Plate

The simple form of the base plate 51 incorporates two separate pivots, a first forward pivot P1 to provide for control of decrease in pitch (pitch-down) and a second rear pivot P2 to provide for control of increase in pitch (pitch-up).

The base plate 51 is also provided with:

(a) an attachment 85 with an access hole at one side through which a handle 23 may be passed to attach to the lower part of the pitch lever 52 for overall control of tremolo function.

(b) a means to attach a saddle or saddles between the pitch lever and the forward edge of the bridge assembly over which the strings pass to the tuning machines at the end of the guitar neck.

First Pivot (Pitch-Down)

The first forward pivot uses the existing forward pivot mounting for the pitch-down function. This may be formed by a line of screws across the forward horizontal edge of the base plate or two pivot posts at either side of the forward edge of the base plate or a knife edge or hinge formed by or on the forward edge of the base plate engaging with a receiver attached to the guitar body.

Second Pivot (Pitch-Up)

The second pivot may be:

(a) in the form of an inset knife or rounded edge, formed at the rear horizontal edge of the base plate and of a lesser width than that of the pitch lever, providing both the pivot for the pitch lever to bear on and a means of preventing the pitch lever moving both horizontally or vertically by engaging with slots at either edge of and in line with the pivot bearing surface of the pitch lever.

(b) in the form of a hinge, that replaces the knife edge with an axle that passes through bearings on the base plate and pitch lever connecting the two in position.

Bracket

The bracket 53 attaches to the underside of the base plate 51 forward of the rear pivot P2 and extends into the body of the guitar passing through a rectangular slot 74 in the pitch lever 52 to provide:

(a) a means for collective forward rotation of the bridge assembly on the first pivot P1, (b) a limit to independent forward rotation of the pitch lever on the second pivot P2, (c) attachment points to anchor the tension springs 36 within the body of the guitar to the bridge assembly.

Pitch Lever

The pitch lever 52 is located and rests against the rear pivot P2 of the bridge base plate 51, maintained in position by horizontal slots on either side of the lever that engage with the base plate in line with the rear pivot.

The slots are constructed so as to:

(a) fit the width and depth of the base plate on either side of the rear pivot, (b) allow the bearing portion of the lever to rest snugly on the rear pivot, (c) stop vertical or lateral movement of the lever, (d) have an angled or curved profile to permit the lever to rotate backwards and increase string tension.

The lever itself extends above and below the upper surface of the body of the guitar the upper external part of which provides an attachment for the strings, the lower or internal part having a rectangular hole through which the bracket passes and having an attachment for a handle accessible through an access hole in the base plate.

Handle

The handle 23 attaches to the internal part of the pitch lever 52 and operates the tremolo function by:

(a) collective forward rotation of the bridge assembly on the first forward pivot P1, (b) individual backward rotation of the pitch lever on the second rear pivot P2.

Bridge

The bridge itself is formed by either:

(a) one wide horizontal saddle supporting all the strings at the scale length of the guitar, attached to the surface of the base plate between the pitch lever and the first pivot point over which all the strings pass from the pitch lever to the tuning machines.

(b) a number of narrow individually adjustable saddles 66 on the surface of the base plate 51 between the pitch lever and the first pivot point 72 over which individual strings 13 pass from the pitch lever to the tuning machines. This is shown in FIG. 6.

Referring to the basic foundations as illustrated in FIG. 5, the first part is a base plate 51 that extends across the transverse slot. The second part is a stop bracket 52 that attaches to and is fixed to an underside of the base plate 51 and extends at substantially a right angle into the transvers slot 25. The third part is a separate pitch lever plate 53 that is pivotally hanging on the base plate 51 and restricted in pivotal rotation by engaging the stop bracket.

Figure 10:
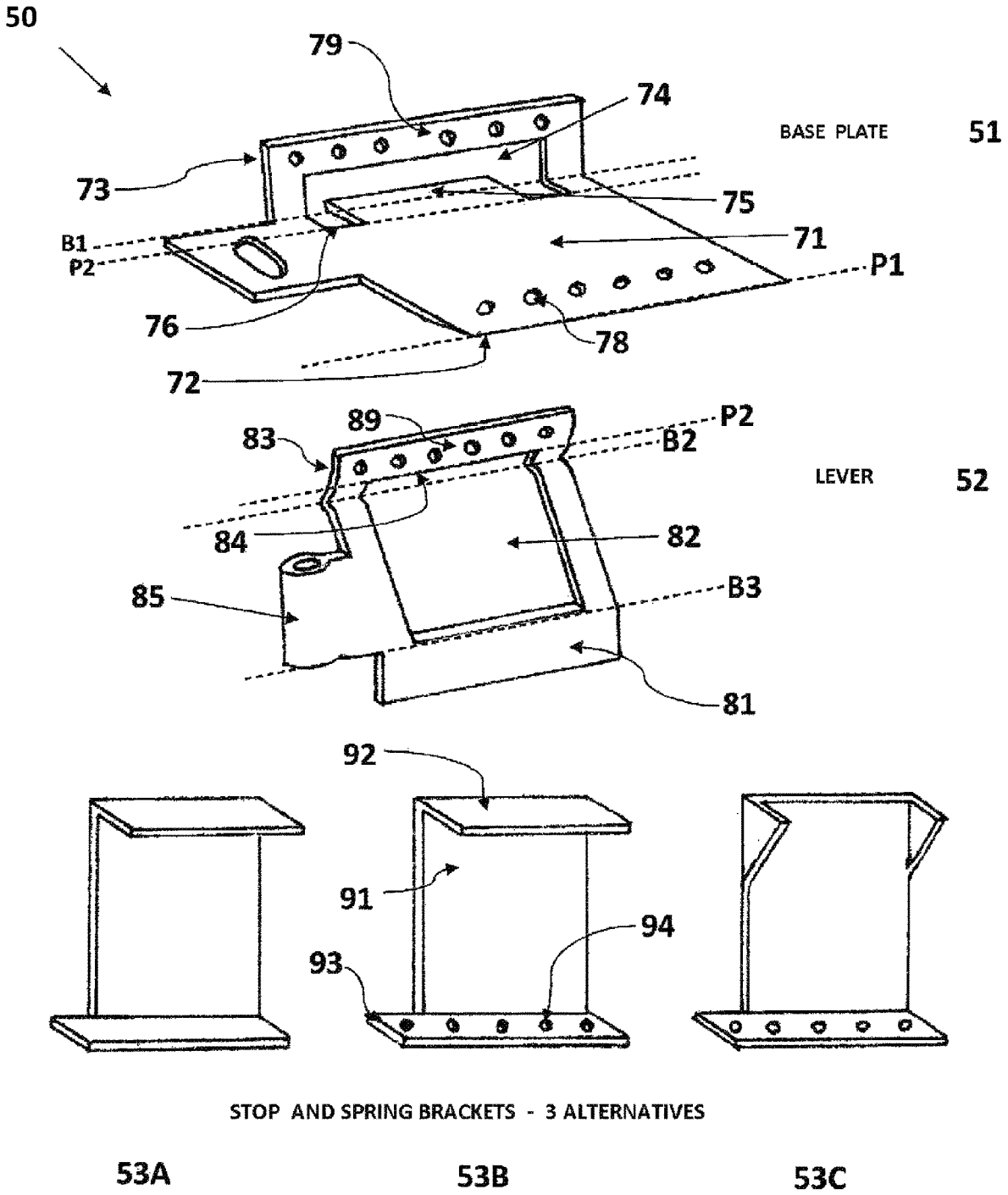
FIGS. 10 and 11 are diagrammatic component views preferred embodiments of the improved tremolo device for the Fender Stratocaster of FIG. 1 showing separate components of base plate, pitch lever and stop and spring brackets in front perspective views of the tremolo device in accordance with a preferred embodiment of the present invention with three alternative stop and spring brackets.

The base plate 51 of the embodiment of the invention as shown in FIG. 10 is formed of a substantially flat plate 71 that has one narrowing knife edge 72 that forms a first primary pivot point 61 of the base plate. Pivot screws 77 can be fitted in holes 78 adjacent the knife edge 72 to allow rocking of the base plate 51 and a resting on the pivot point to not deaden the vibration sound of the tensioned string that fit over a bridge mounted on the base plate.

The flat plate 71 extends to an end distal from the pivot point 61 and has a bent inverted U-shape arm 73 with holes 79. The U-shape arm 73 has an inner cutout 74 from the flat plate 71 with the resulting U-shape arm 73 bent upwardly at fold B1 away from the connection to the flat plate. The cutout 74 is primarily a rectangular shape before bending but retains a smaller rectangular tongue 75 that remains coplanar with the rest of the flat plate 71 and has side cutout edges 76 on either side of the tongue 75 to form secondary pivot edges P2. In particular B1 is parallel spaced from P2.

The pitch lever plate 53 appears as if formed as a flat plate with a rectangular cutout 82 to leave a perimeter rectangular annular body 81. However, the flat annular body 81 has two parallel folds. A first B2 near the top edge of the cutout and a second B3 near the bottom of the cutout. The folds at B2 and B3 are oppositely directed to each other so as to form a top inverted U-shape part 83 on one side of the axis of extension of the This resulting crank shape of the pitch lever plate 52 is particularly clearly shown in FIG. 4. The top inverted U-shape part 83 is cup shaped and includes holes 84 for receiving the ends of the strings 13 and form the end mount 14 of the strings 13.

The second part being the pitch lever plate 53 includes an attachment 85 at a side with inner cylindrical hole that can receive the lower end of the tremolo lever 23 in frictional sliding manner or in other forms in screw-in manner.

It should be noted that the form of constructing need not be in this way but aids understanding of the shaped forms.

The third part being the stop bracket 52 is a substantially planar plate 91 with top and bottom parts 92, 93 folded in the same direction at substantially right angles to form flaps parallel and overlaying flaps. The top flap 92 forms a connecting part for connecting such as by welding to the underside of flat plate 71 of the base plate 51 so as to extend at right angles thereto. The bottom flap 93 includes holes for receiving tension spring 36.

In general operation with reference to FIGS. 4, 5 and 6 the base plate 51 extends over the transverse slot 25. The pivot knife edge 72 is mounted by pivot screws 77 to the body 11 on one side of the transverse slot 25 while the other end of the base plate 51 overlays and can engage the body 11 on the other opposite side of the transverse slot 25.

With the third part being the stop bracket 52 attached to and extending at right angles to the base plate 51, it extends into the transverse slot 25 when the base plate extends across the transverse slot. At the bottom end the tension spring 36 mounted to an inner part of the body in the longitudinal back slot 26 and connected into the holes 94 on the bottom flap 93 of the stop bracket resiliently forces the pivoting of the base plate 51 back to a position engaging the top of the body 11 and closing the top of the transverse slot 27.

In this way the base plate 51, having a bridge mounted thereon, can pivot in one direction away from the body 11 but be limited in the other direction by engaging the body 11. This has a substantial benefit in one element of limiting the effect of the resilient spring tension spring that is connecter to and resiliently holding the base plate 51 by the attachment to the stop bracket 52.

It can be seen that one benefit of the invention is that the previous delicacy of selection of the right tension of tension spring 36 is no longer required to balance with the tension of the strings 13 but is one element of improvement by separation of the resilience of the spring from the tension of the strings.

The other element that effects the separation is the pitch lever plate 52 that is pivotally mounted on the base plate 51. The pitch lever plate 52 is intertwined between the base plate 51 and the stop bracket 53B by the pitch lever plate 52 fitting over the stop bracket 53B by the latter fitting through the cutout 82 of the former. Then the pitch lever plate 52 is lifted up to the attached base plate 51 and the bottom edge 84 of the top inverted U-shape part 83 of the pitch lever plate 52 is hung pivotally on the tongue 75 of the base plate 51 so as to pivotally rock along pivot axis P2.

The strings are mounted into the top inverted U-shape part 83 which is cup shaped and includes holes 89 for receiving the ends of the strings 13 and forms the bottom end mount 54 of the strings 13.

Even though the base plate 51 now mounts the plurality of strings 13, each string is also fine tunable by means of a box saddle 66 that is mounted on a string height adjusting screw 68 and spaced from the base plate 51 upright by longitudinal spaced screws 67 for each string.

It can be seen that the ends of these strings 13 in the bottom string mount 14 are always readily accessible at a position above the transverse slot 25.

It also can be seen that the strings 13 extend from respective end mounts 14 in top end of the pitch lever plate 52 external of the guitar cavity 25 and extend over the box saddle 66 to the other end at the head of the guitar. Apart from adjustments at the head fine tuning can be achieved by each string by adjustment of the location of the box saddle in two directions and thereby fine tuning the tension in the strings.

It can also be seen that although the tremolo 50 affects all of the strings due to the base plate 51 and pitch lever plate 52 mounting all of the strings 13 that each of the strings are not affected by the other strings. Therefore failure or out of tuning of one string will not affect the other strings even though the tremolo affects all of the strings. This overcomes the problem of needing to reset all strings when one string fails.

The tremolo lever 23 when mounted into the inner cylindrical hole of the attachment 85 at the side of the pitch lever plate 52 directly moves the pitch lever plate 52 and has varying effect on the base plate 51 and connected stop bracket and varying effect on the tension of the strings 13.

Effectively there are three main differences of operation.

At a first mode of operation in neutral play there is the conditions of:

a) The tension spring 36 resiliently pivots the base plate 51 to a closed position over the transverse slot;
b) The tremolo lever 23 is not activated in a balanced position; and
c) The pitch lever plate 52 is in a balanced position.

Therefore, at this point the tension of the strings is in a fixed tunable position similar to a guitar without a tremolo device.

At a second mode of operation in pitch down play there is the conditions of:

a) The tension spring 36 resiliently pivots the base plate 51 towards a closed position over the transverse slot;
b) The tremolo lever 23 is activated in a forward position and pivots the pitch lever plate 52 forward around pivot P2 at 72; and
c) The top of the pitch lever plate 52 is moved forward but only till the bottom of the pitch lever plate 52 engages the stop bracket and pivots the base plate 51 open around pivot P1 against the resilience of the tension spring 36.

Therefore, at this point the string end mount 54 is moved forward and the tension of the strings 13 is reduced from the fixed tunable position to provide a variation of pitch and a tremolo effect.

At a third mode of operation in pitch up play there is the conditions of:

a) The tension spring 36 resiliently pivots the base plate 51 to a closed position over the transverse slot;
b) The tremolo lever 23 is activated in a backward position but no longer against any resilience of the tension spring 36 as the base plate has engaged the body on both sides of the transverse slot and can no longer pivot further around P1; and
c) The pitch lever plate 52 is in a balanced position.

Therefore, at this point the string end mount 54 is moved backwards and the tension of the strings 13 is increased from the fixed tunable position to provide a variation of pitch and a tremolo effect.

Therefore, it can also be seen that the tremolo device of the invention has various forms with one or more of the following novel and inventive elements. The invention is not limited to the particular disclosed example but includes other forms as would be understood by the person skilled in the field.

These elements include:

a) Accessibility of end String mounts
b) Separation of tremolo mount and string mount
c) Pivoting Examples
d) Interaction of parts to form combined apparatus
e) Mountability of combined apparatus Referring to FIGS. 7 to 18 there are shown forms of the tremolo device of the invention in which the pivoting relationship between the pitch lever plate 52 and the base plate 51 is not by simple rocking along a pivot axis but instead use a hinge process to capture the pivoting action.

In the embodiment shown by FIGS. 7 to 10 the hinge 3 embodiment has a stop bracket 153 that is connected by tension spring at one end and fixed to the perpendicularly extending base plate 151 that overlays the guitar body over the guitar tremolo cavity 25. However, the pitch lever plate 154 is now hingedly connected to the stop bracket 153 and extends above the guitar body.

Figure 8:
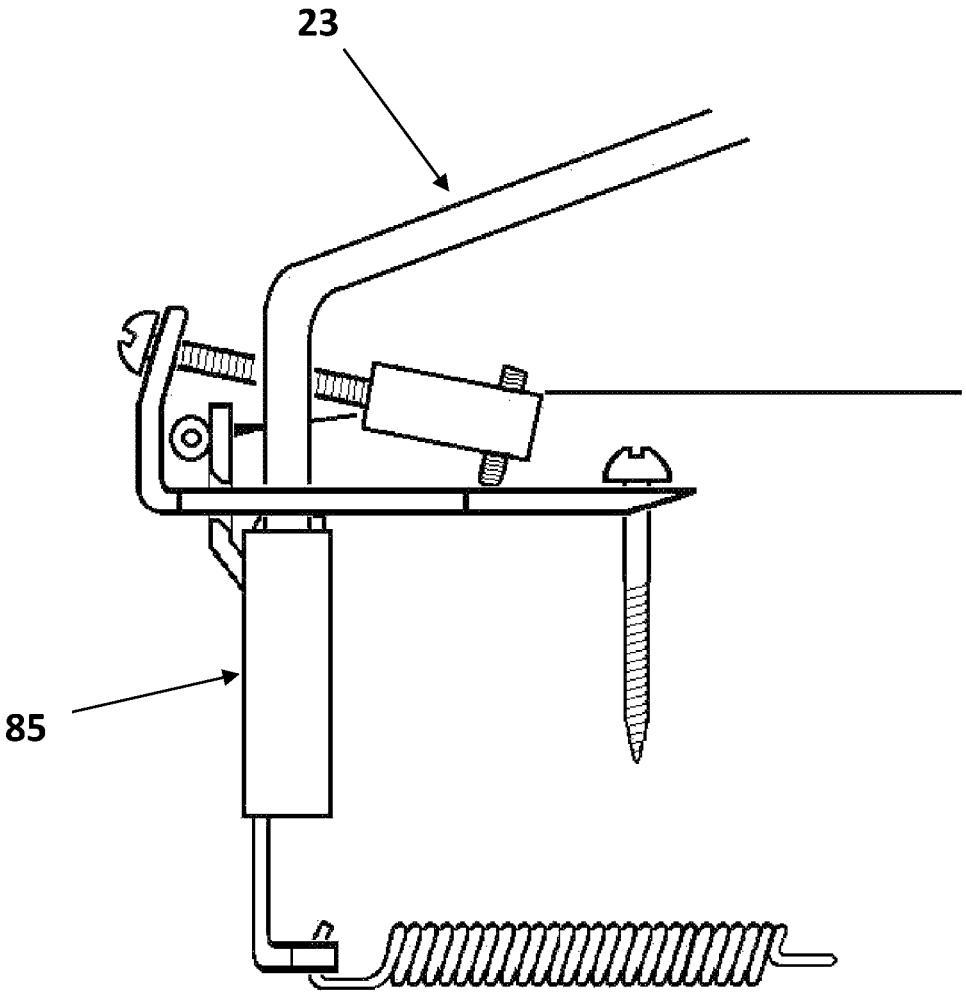
Figure 9:
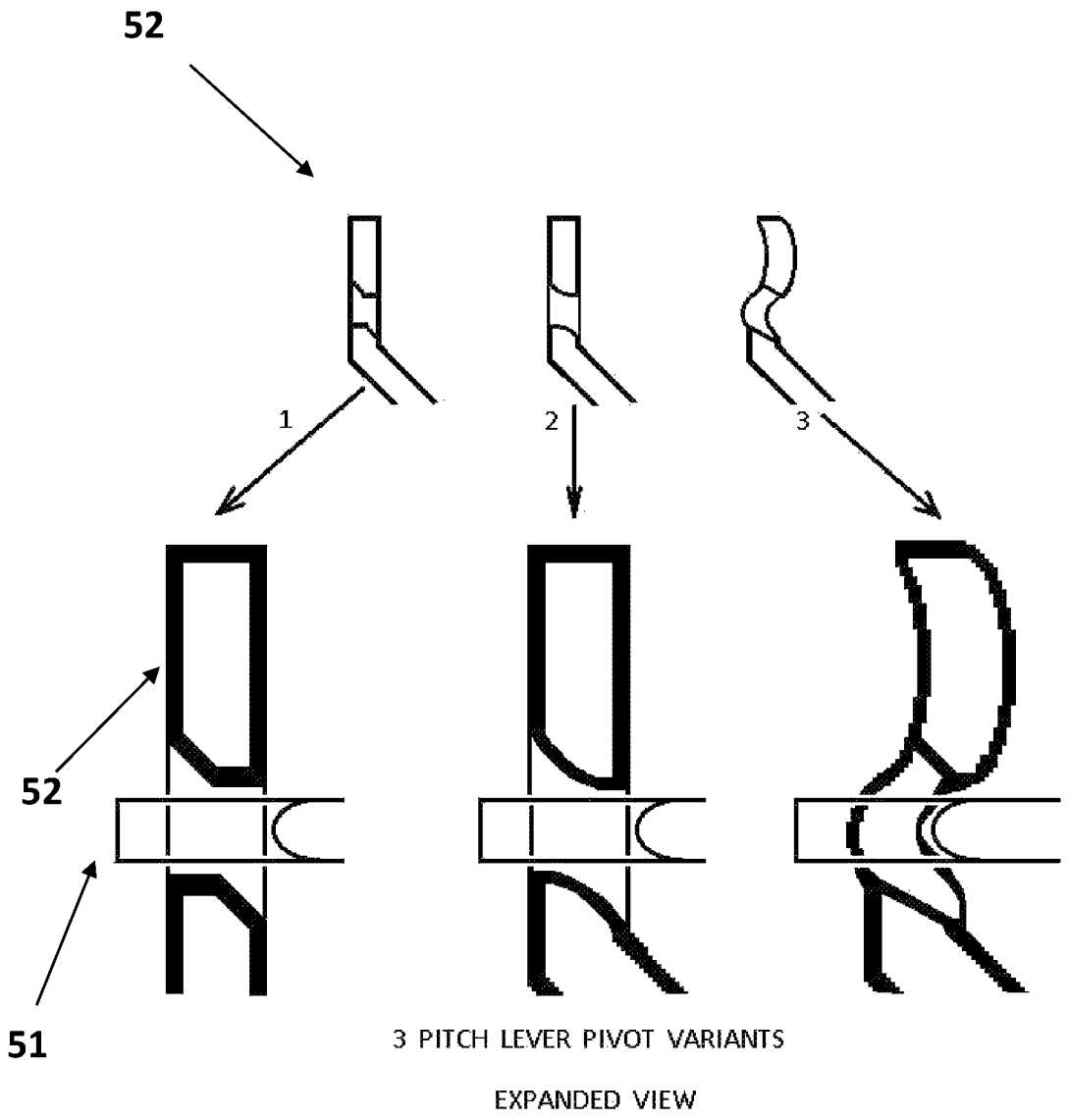
FIG. 9 is a diagrammatic view of tree pivot systems of the pitch lever on the base plate in accordance with embodiments of the invention.

In use FIGS. 7 and 8 show the neutral position from each side of the guitar. However, FIG. 9 shows the pitch up position in which the tremolo handle 23 is moved backwards and the hinged pitch lever plate 154 also pivots backwards which adds tension to the strings and increases the pitch. It can be seen that operation is separate to the tension provided by the tension spring 36 to force the base plate 151 to remain in a closed position over the opening of the guitar cavity 25. FIG. 10 shows the pitch down position in which the tremolo handle 23 is moved forwards and the base plate 151 also pivots forward with the hinged pitch lever plate 154 staying in relative hinged position to the neutral position which in effects also pivots forwards which releases tension to the strings and decreases the pitch.

It can be seen that this system also maintains the primary improvements of the invention of:

a) Maintaining the strings above the guitar body for ready access;
b) separation of the resilience of the spring to the tension of the strings; and
c) avoiding effect of failure or out of tuning of one string affecting the other strings even though the tremolo affects all of the strings.

In the embodiment shown by FIGS. 11 to 14 the hinge 4 embodiment has a stop bracket 253 that is connected by tension spring 36 at one end and fixed to the perpendicularly extending base plate 251 that overlays the guitar body over the guitar tremolo cavity 25. However, the pitch lever plate 252 is now hingedly connected to the stop bracket 253 in a different hinge mode but still extends above the guitar body.

Figure 11:
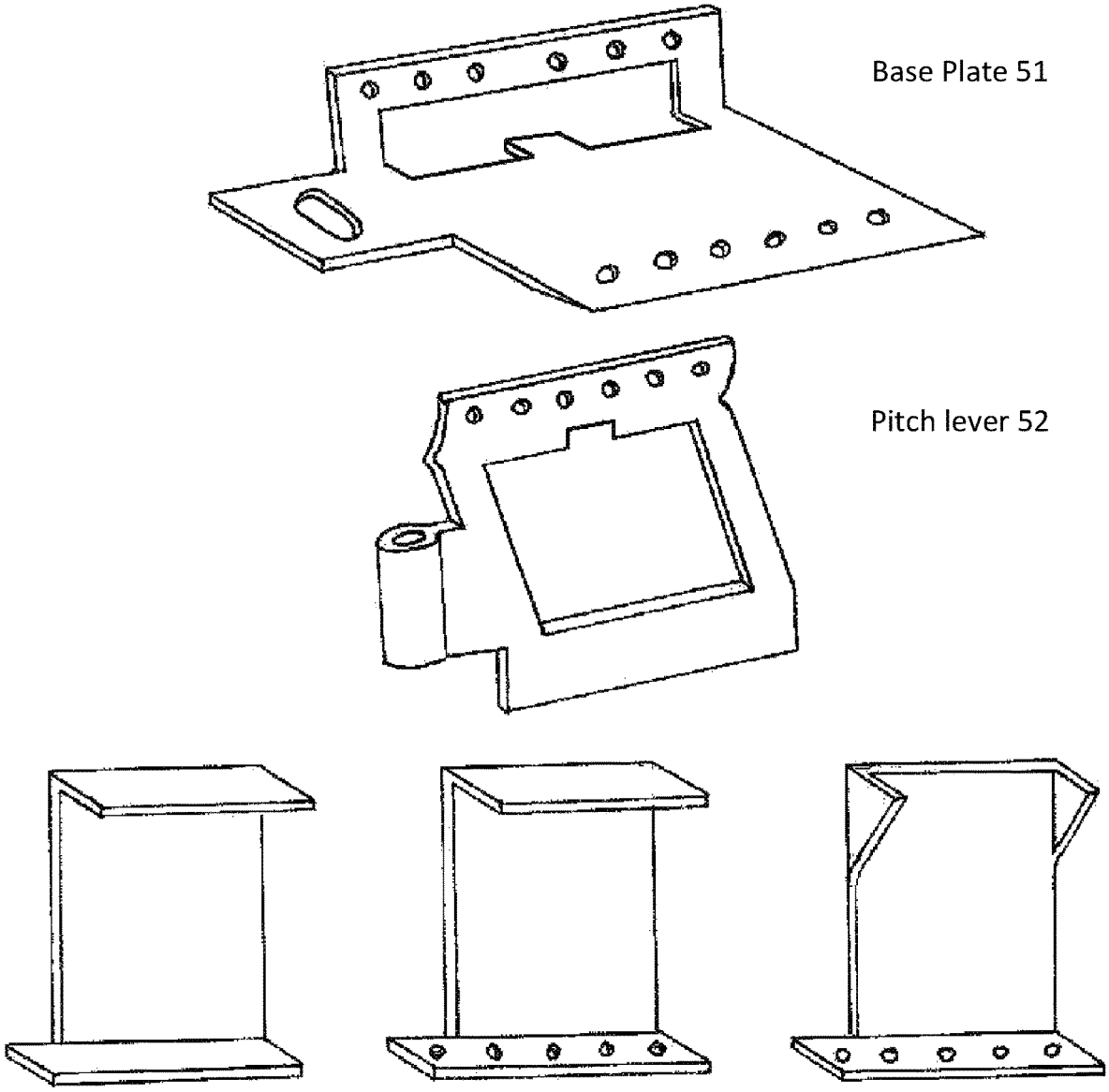
Figure 12:
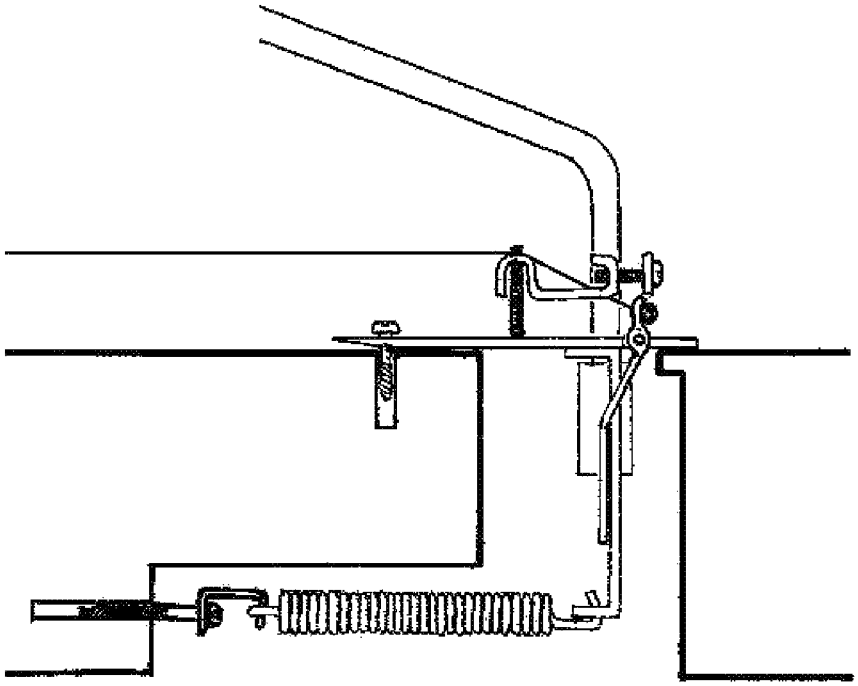
FIGS. 12 and 13 are diagrammatic sectional views along the longitudinal axis of the Fender Stratocaster of FIG. 1 showing the tremolo device of FIGS. 10 and 11 in functional position and interaction with strings and body of the guitar in accordance with preferred embodiments of the present invention.
Figure 13:
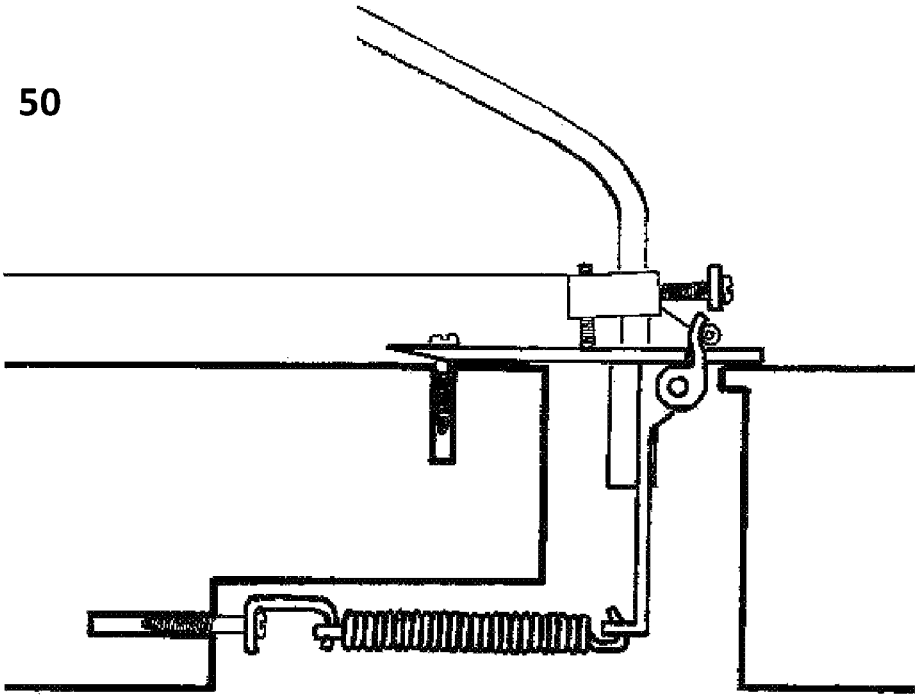
Figure 14:
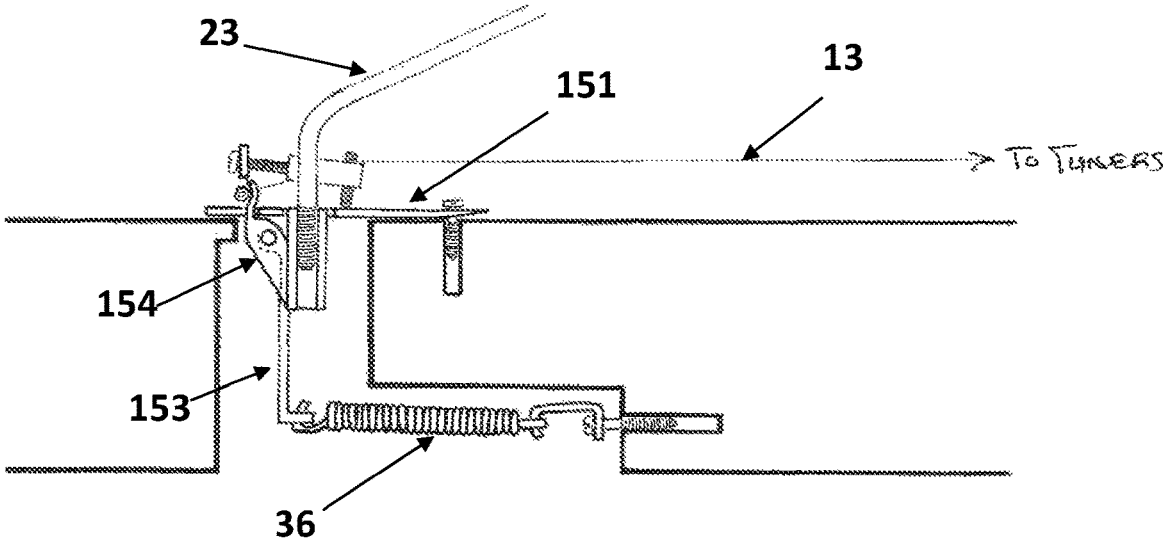
FIGS. 14, 15, 16 and 17 are lever and non-lever side diagrammatic sectional views along the longitudinal axis of the of the Fender Stratocaster of FIG. 1 showing the tremolo device in accordance with a further preferred hinge 3 embodiment of the present invention and particularly in FIGS. 15, 16 and 17 in three modes of neutral, pitch up and pitch down modes between which the tremolo device can operate.
Figure 15:
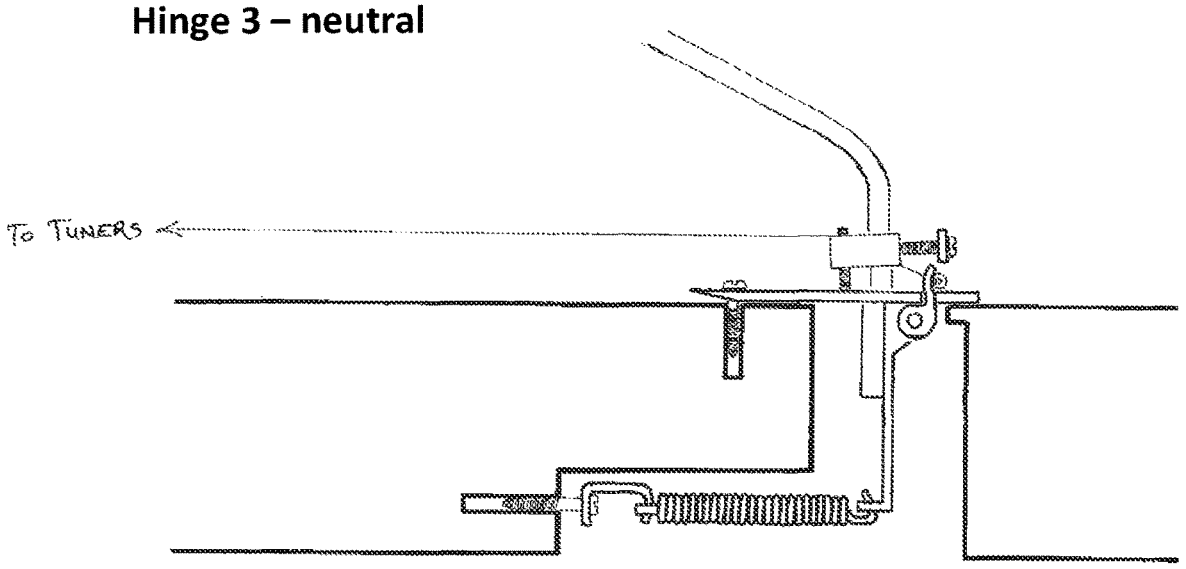

In use FIG. 11 shows the neutral position from each side of the guitar. However, FIG. 13 shows the pitch up position in which the tremolo handle 23 is moved backwards and the hinged pitch lever plate 252 also pivots backwards which adds tension to the strings and increases the pitch. It can be seen that operation is separate to the tension provided by the tension spring 36 to force the base plate 251 to remain in a closed position over the opening of the guitar cavity 25. FIG. 14 shows the pitch down position in which the tremolo handle 23 is moved forwards and the base plate 251 also pivots forward with the hinged pitch lever plate 252 staying in relative hinged position to the neutral position which in effects also pivots forwards which releases tension to the strings and decreases the pitch.

In the embodiment shown by FIGS. 15 to 18 the hinge 5 embodiment has a stop bracket 353 that is connected by tension spring at one end and fixed to the perpendicularly extending base plate 351 that overlays the guitar body over the guitar tremolo cavity 25. However, the pitch lever plate 352 is now hingedly connected to the stop bracket 353 by a hinge 355 at the bottom of the stop bracket to provide a different hinge mode.

Figure 16:
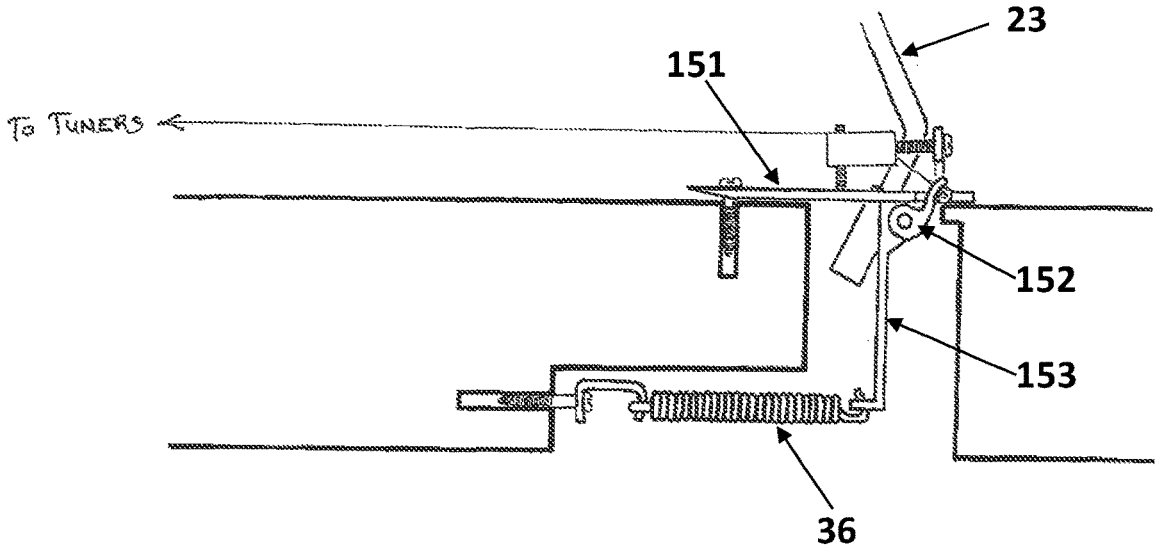
Figure 17:
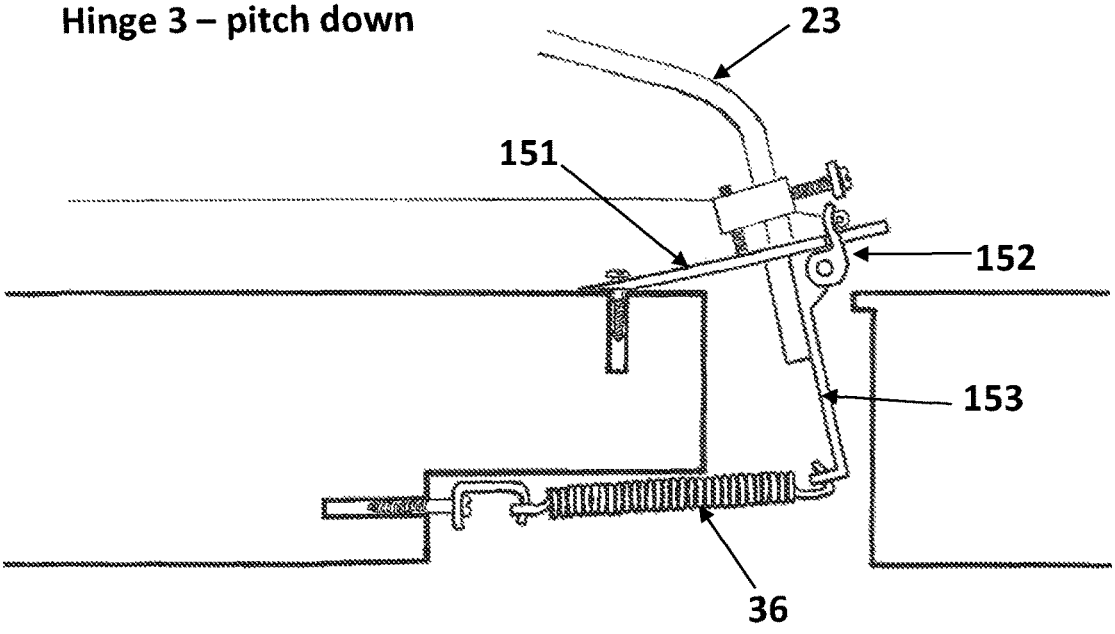
Figure 18:
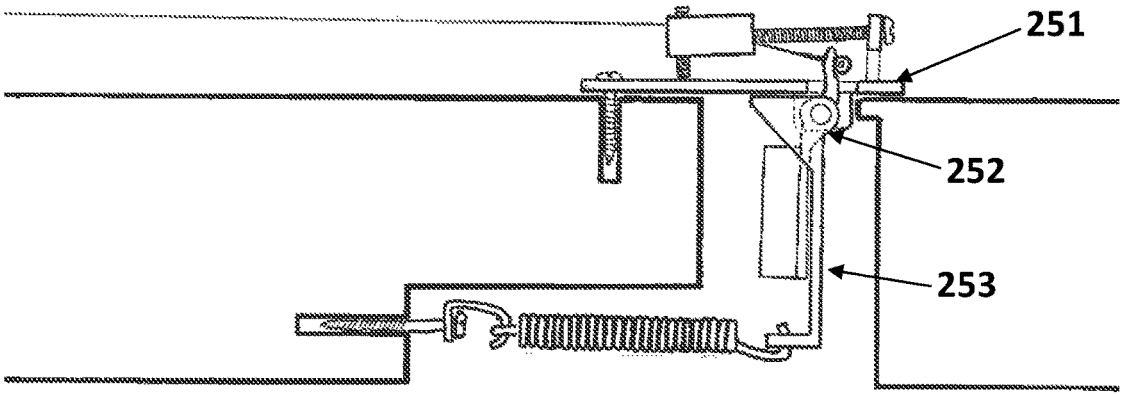
FIGS. 18, 19, 20, and 21 are without lever diagrammatic sectional views along the longitudinal axis of the of the Fender Stratocaster of FIG. 1 showing the tremolo device in accordance with a further preferred hinge 4 embodiment of the present invention and diagrammatic component view along the longitudinal axis of the of the Fender Stratocaster of FIG. 1 showing separate components of base plate, pitch lever and stop and spring brackets in front views of the tremolo device in accordance with a further preferred hinge 4 embodiment of the present invention and particularly in FIGS. 20 and 21 in two modes of pitch up and pitch down modes between which the tremolo device can operate.
Figure 19:
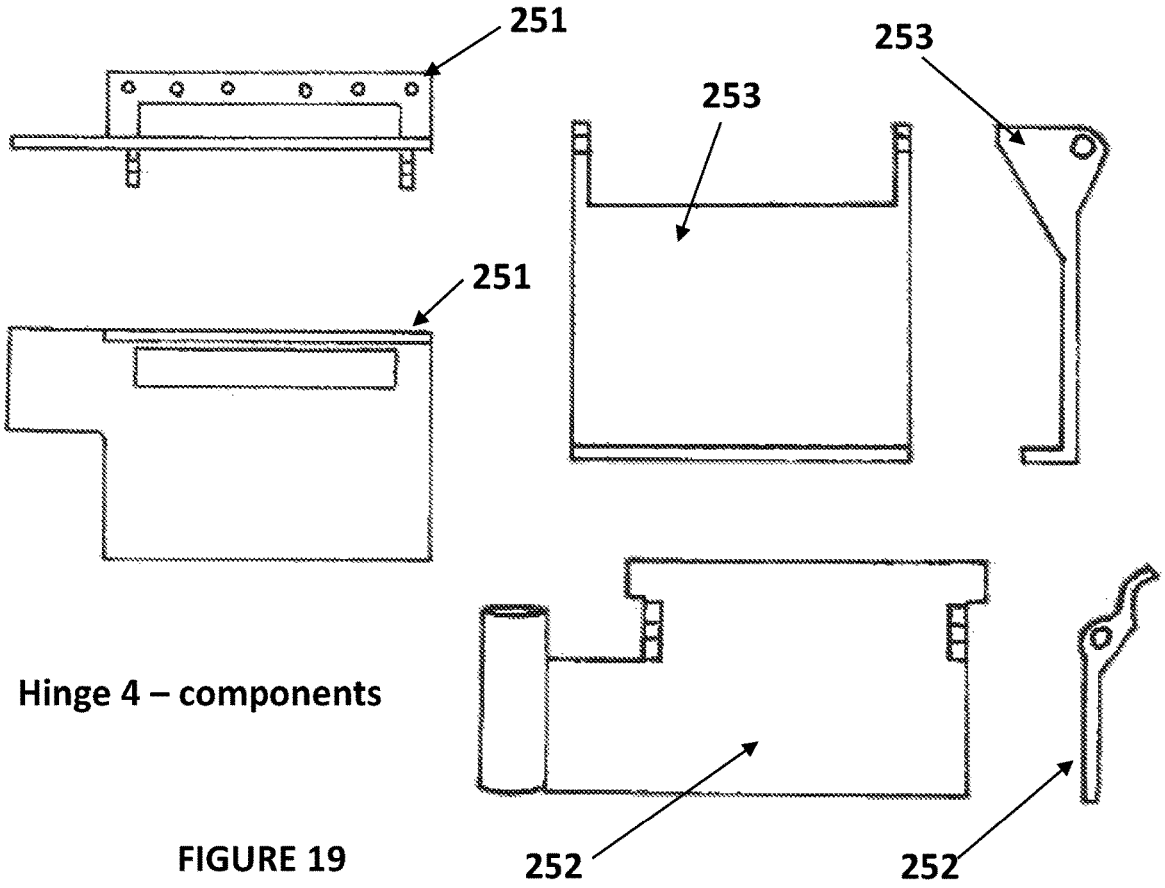
Figure 20:
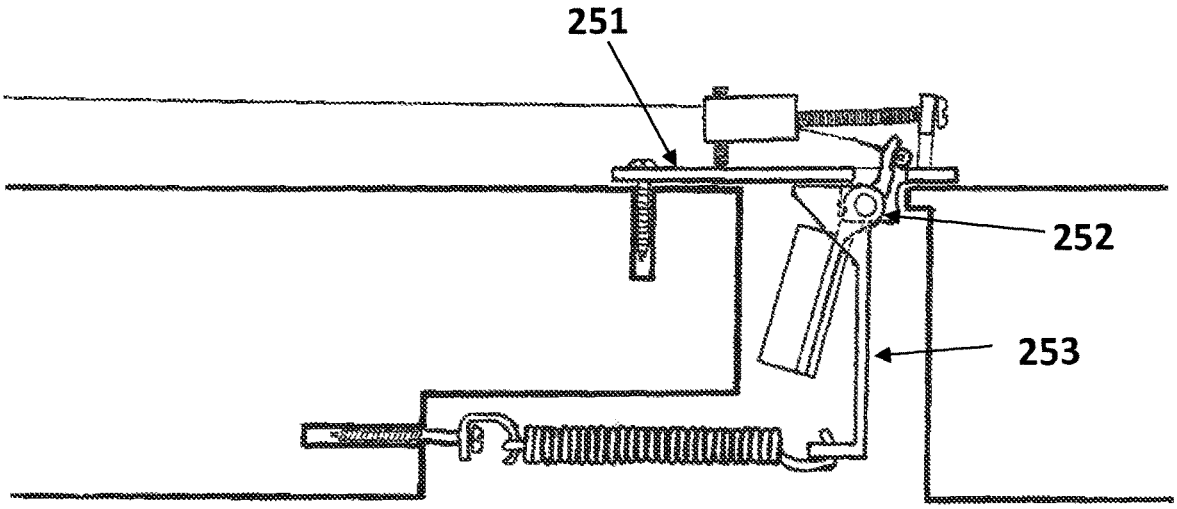
Figure 21:
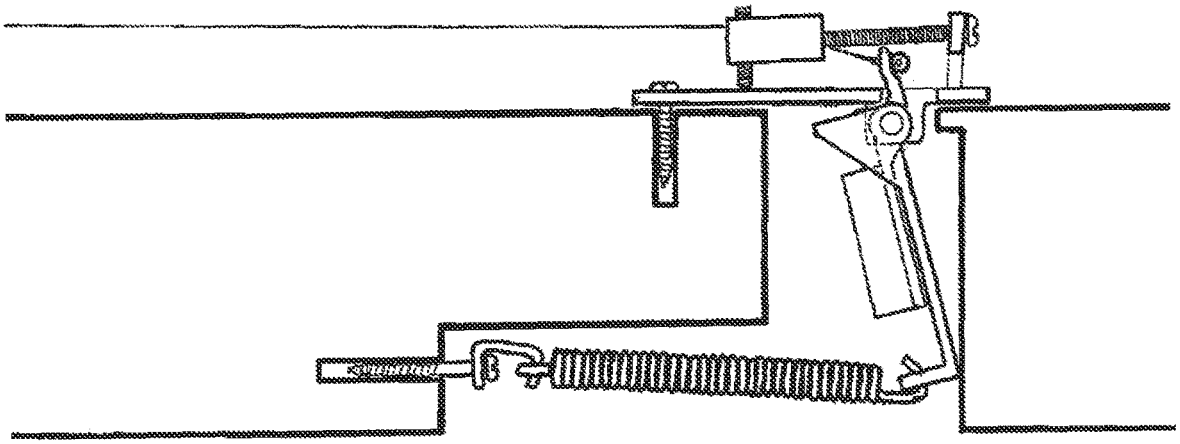
Figure 22:
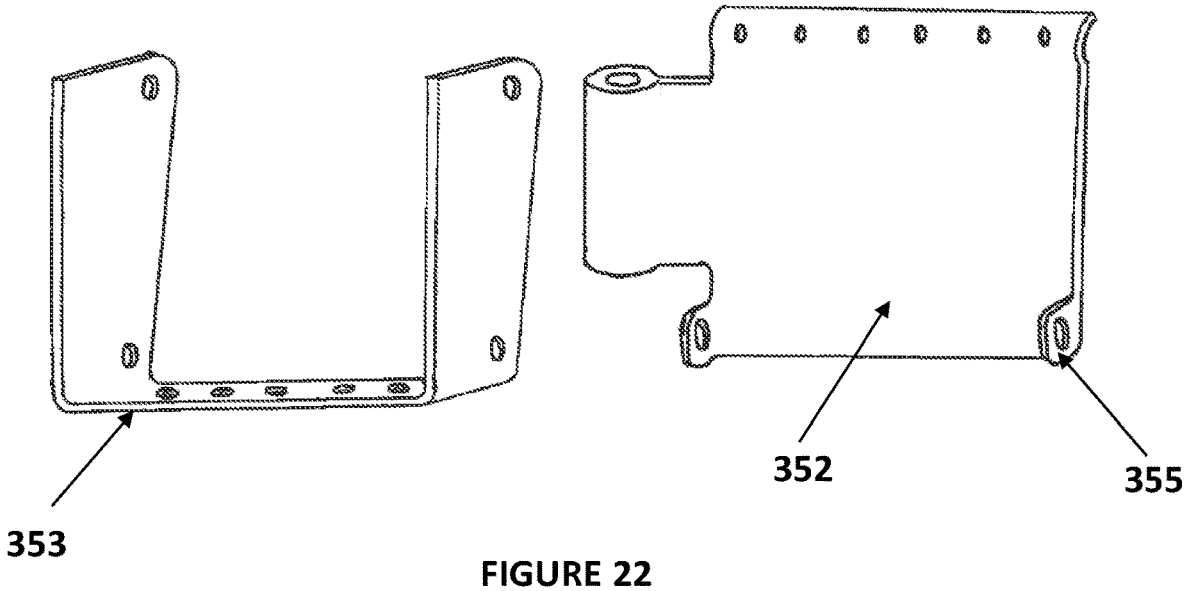
FIGS. 22, 23, 24 and 25 are diagrammatic component view and without lever side diagrammatic sectional views along the longitudinal axis of the of the Fender Stratocaster of FIG. 1 showing the tremolo device in accordance with a further preferred hinge 5 embodiment of the present invention and particularly in FIGS. 23, 24 and 25 in three modes of neutral, pitch up and pitch down modes between which the tremolo device can operate.
Figure 23:
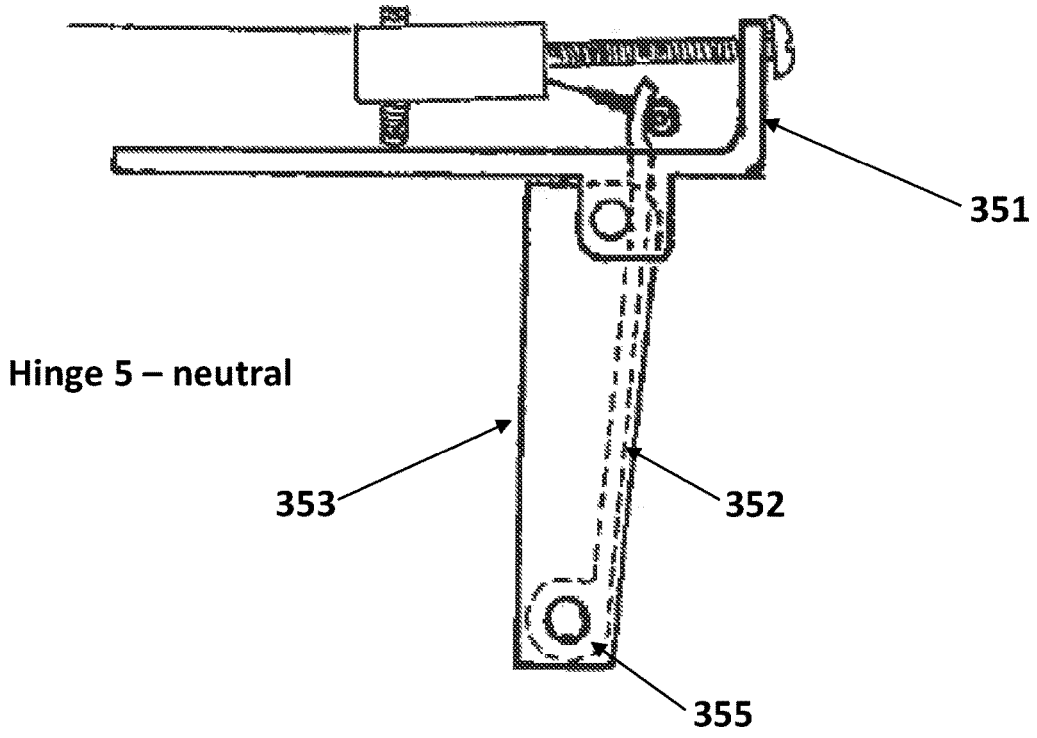
Figure 24:
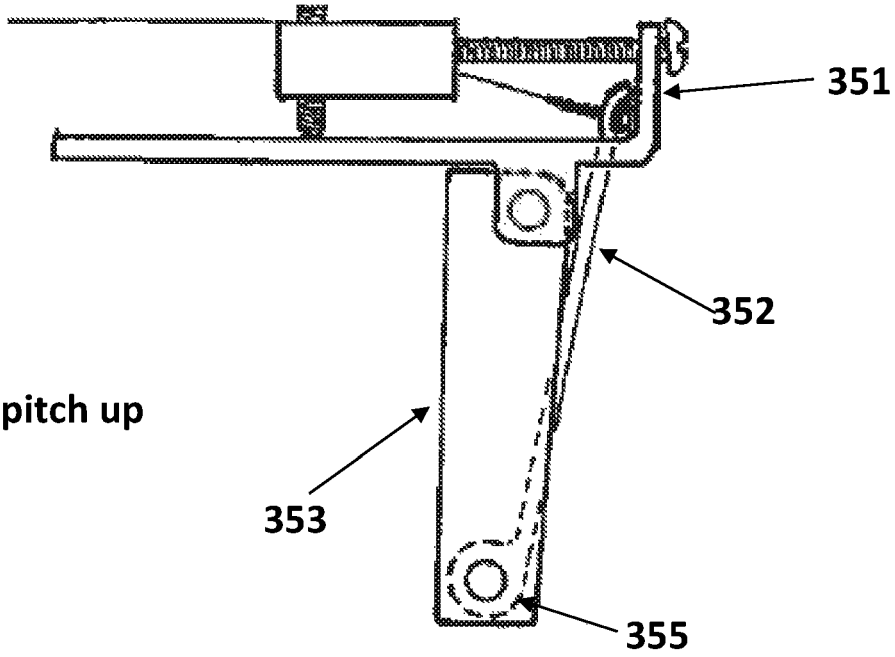
Figure 25:
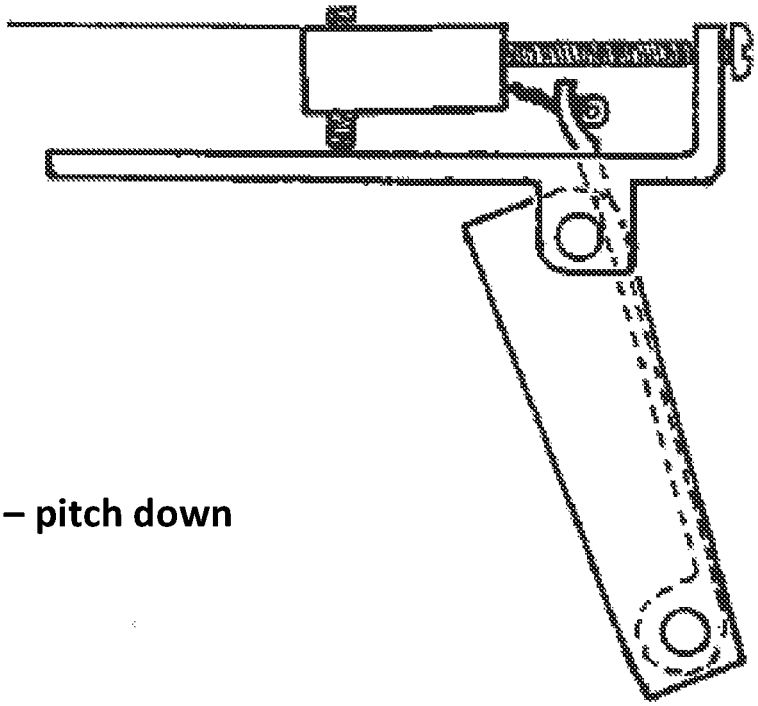
Figure 26:
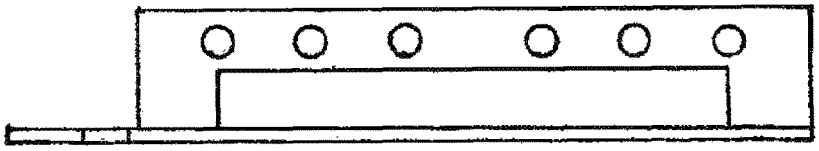
FIG. 26 is a front elevation of separate components the tremolo device in accordance with a third preferred embodiment of the present invention.
Figure 26:
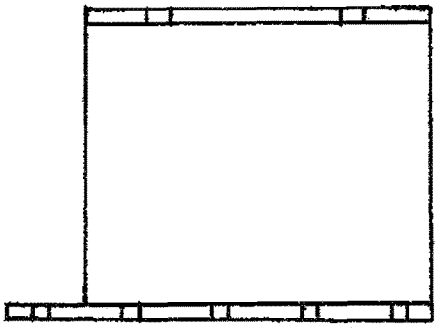
Figure 26:
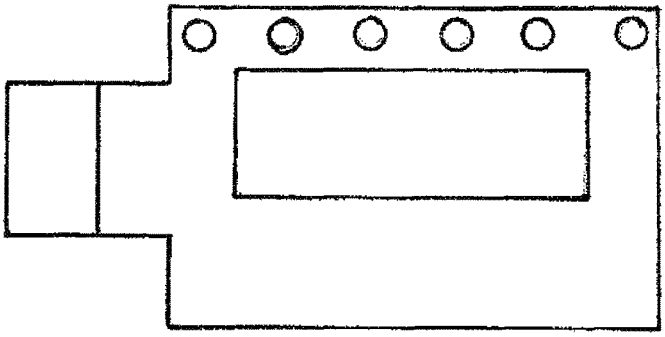
Figure 27:
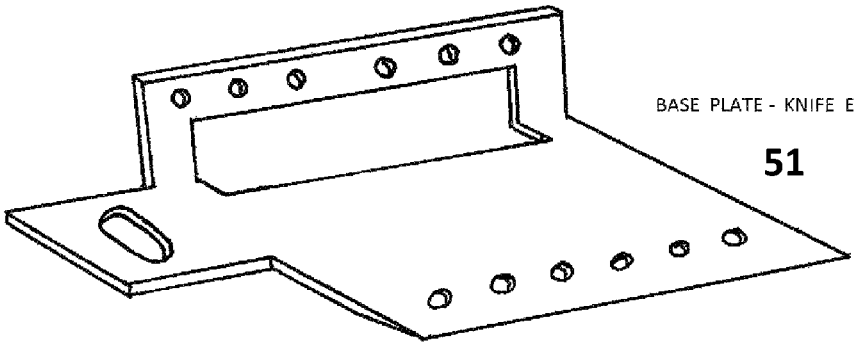
FIG. 27 is a front elevation of separate components the tremolo device in accordance with a fourth preferred embodiment of the present invention.
Figure 27:
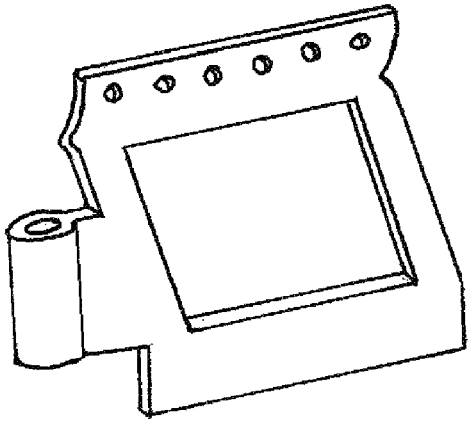
Figure 27:
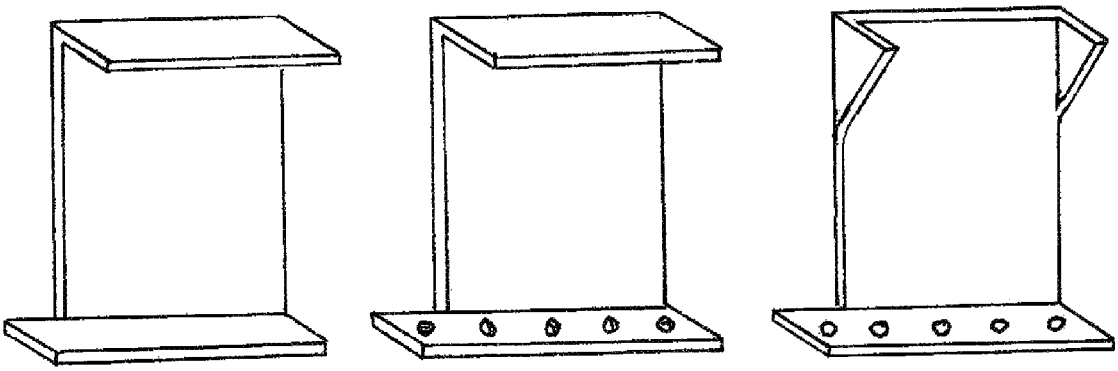
Figure 28:
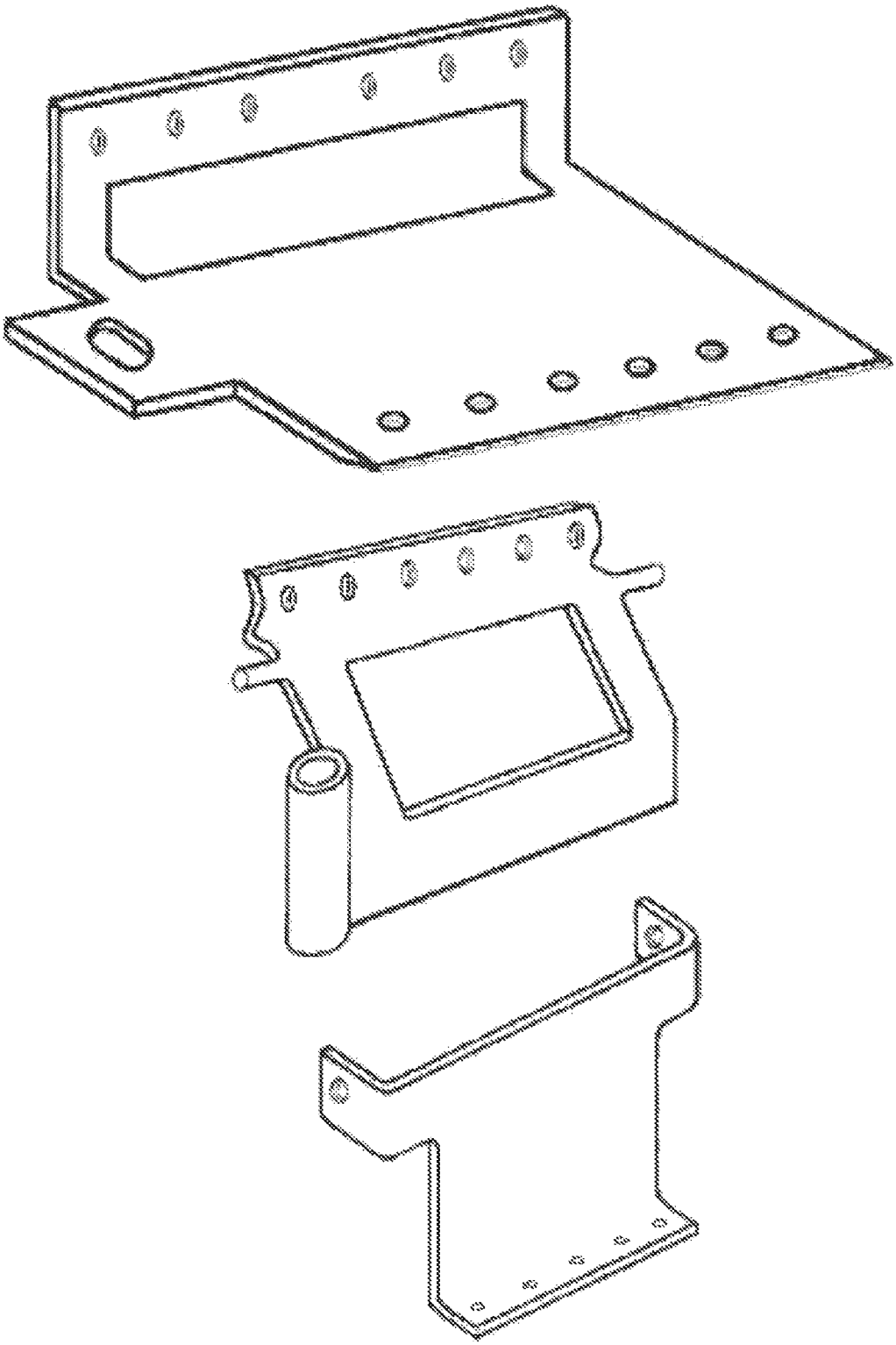
FIG. 28 is a front elevation of separate components the tremolo device in accordance with a fifth preferred embodiment of the present invention.
Figure 29:
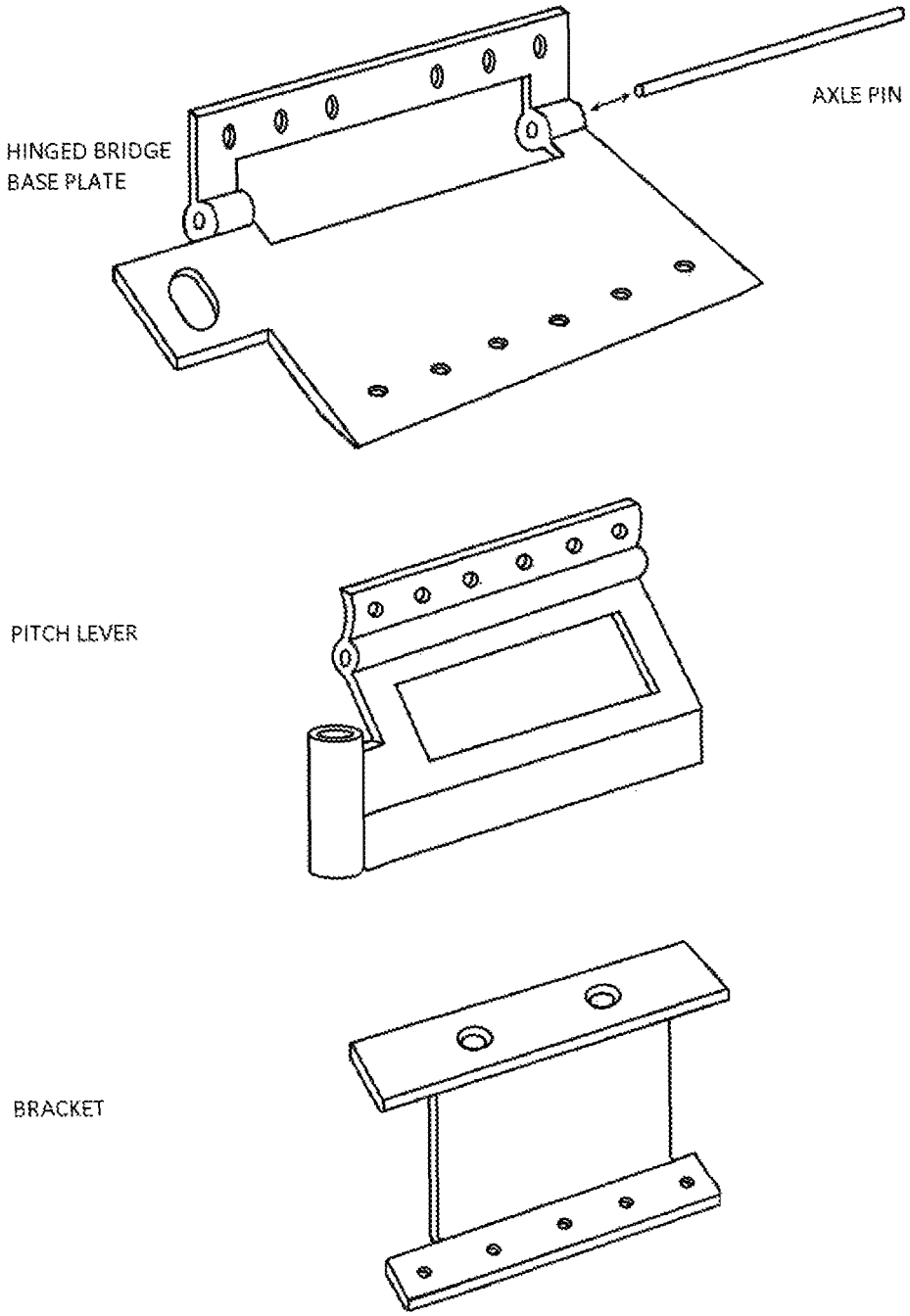
FIG. 29 is a front elevation of separate components the tremolo device in accordance with a sixth preferred embodiment of the present invention.
Figure 30:
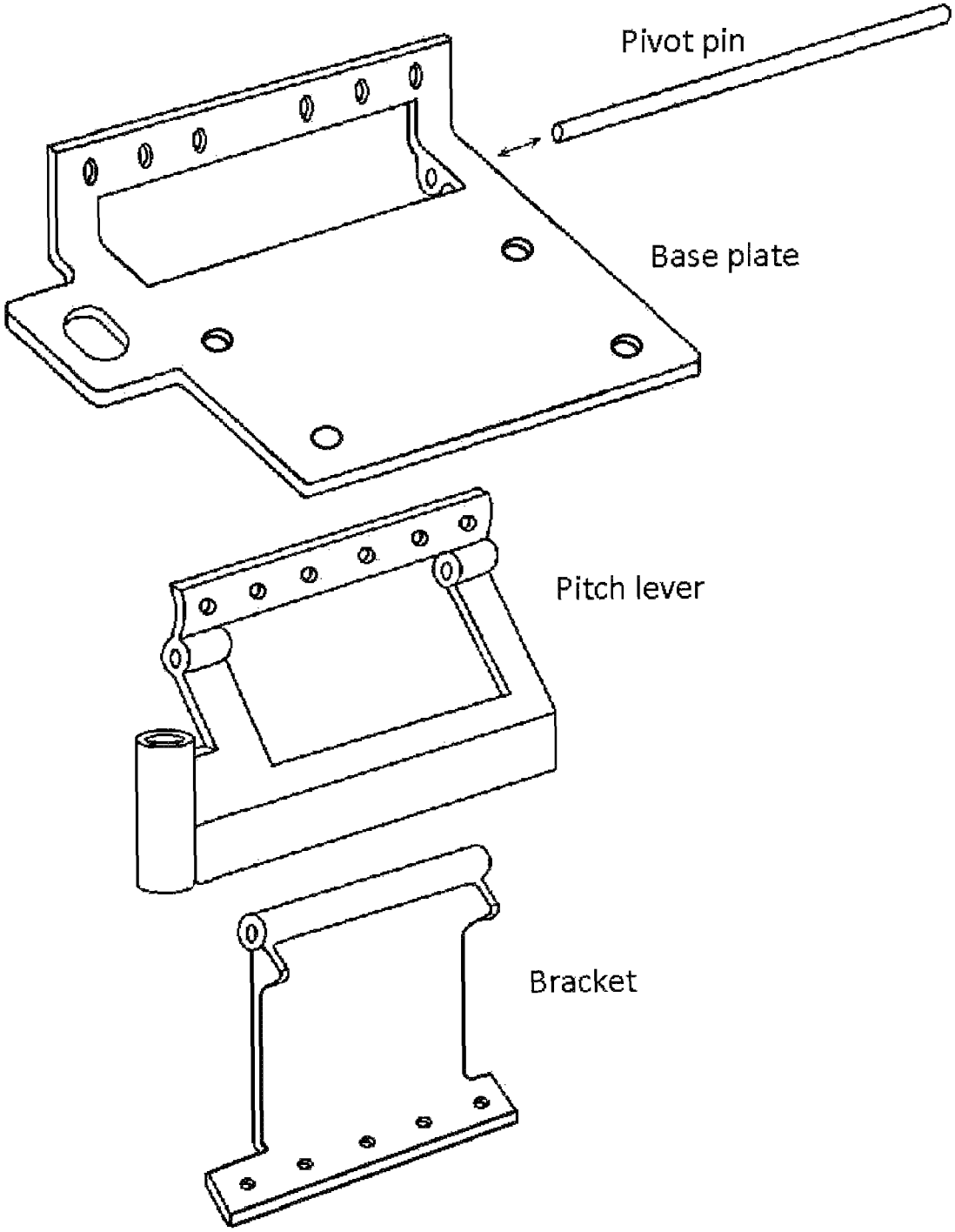
FIG. 30 is a front elevation of separate components the tremolo device in accordance with a seventh preferred embodiment of the present invention.
Figure 31:
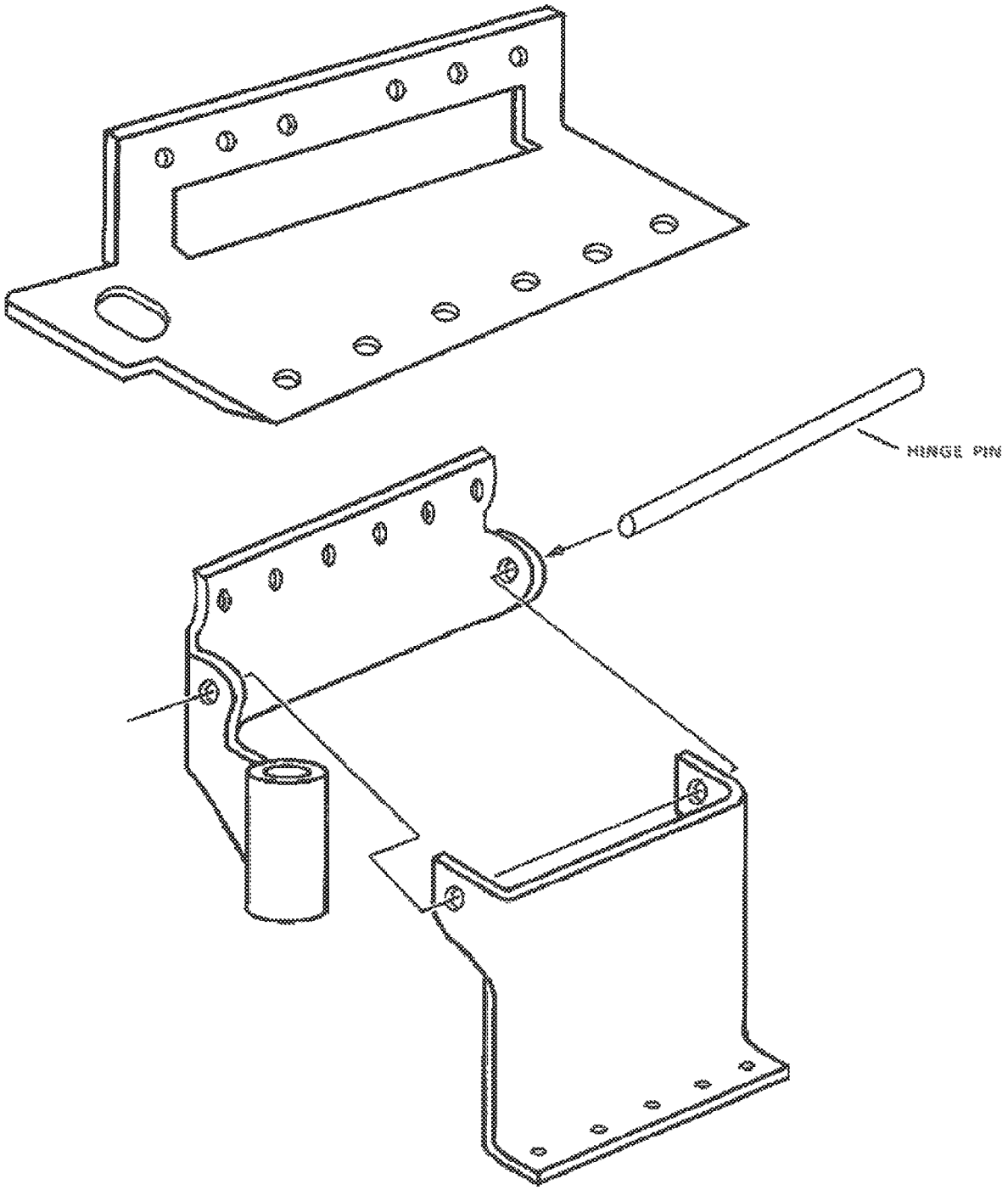
FIG. 31 is a front elevation of separate components the tremolo device in accordance with an eighth preferred embodiment of the present invention.
Figure 32:
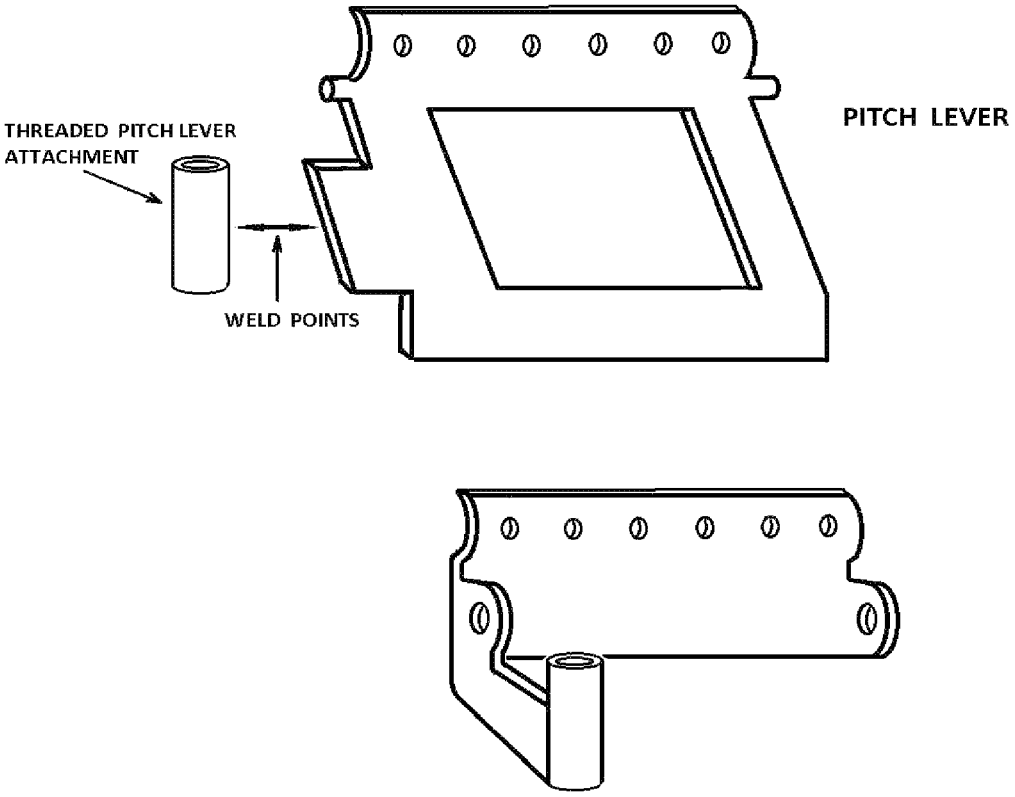
FIG. 32 is a front elevation of separate components the tremolo device in accordance with a ninth preferred embodiment of the present invention.

In use FIG. 16 shows the neutral position from each side of the guitar. However, FIG. 17 shows the pitch up position in which the tremolo handle 23 is moved backwards and the hinged pitch lever plate 354 also pivots backwards around the pivot 355 at the base of the stop bracket 353. This lengthens the string 13 and thereby adds tension to the strings and increases the pitch. It can be seen that operation is separate to the tension provided by the tension spring 36 to force the base plate 351 to remain in a closed position over the opening of the guitar cavity 25. FIG. 18 shows the pitch down position in which the tremolo handle 23 is moved forwards and the base plate 351 also pivots forward with the hinged pitch lever plate 352 staying in relative hinged position to the neutral position which in effects also pivots forwards which releases tension to the strings and decreases the pitch.

FIGS. 19 to 24 show various further forms of pivotal mounting of the three elements of a base plate 51, pitch lever plate 52 and stop bracket 53. By operation of the tremolo handle 23 mounted in a handle mount 85 to the side of the pitch lever plate 52 that has the strings attached at the top outside of the guitar body there is control of pitch by increasing or decreasing tension on the strings by forward or backward movement of the tremolo handle.

That pivotal movement is relative to the base plate 51 which is retained in position by tension spring but due to the separation of movement of the pitch lever plate to the movement of the base plate provides a separation of the resilience of the spring to the tension of the strings.

Other variations of the invention that retains these inventive elements are included within the scope of this invention.

INTERPRETATION

Embodiments:

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment but may. Furthermore, the particular features, structures or characteristics may be combined in any suitable manner, as would be apparent to one of ordinary skill in the art from this disclosure, in one or more embodiments.

Similarly, it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some, but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the music, musical instrument and manufacturing industries.

The invention claimed is:

1. An tremolo device for electric guitars comprising: a. a tremolo mount resiliently mountable on a guitar body adjacent at least one string and the tremolo mount selectively moveable relative to the guitar body; b. a string mount mounted on the tremolo mount in order to receive an end of at least one string of a guitar and the string mount having separate limited movement to the selective movement of the tremolo mount and allow the at least one string to be tunably tensioned;

wherein the selectively moveable tremolo mount includes a primary pivotal mount, wherein in use the primary pivotal mount is resiliently held towards an extended string position but is selectively manually moveable to a less than extended string position;

the string mount including a secondary pivotal mount mounted on the primary pivotal mount; and the secondary pivotal mount including string end mounts for holding the ends of the strings distal from the ends of the strings held by rotatable tuning keys on a top side of the head such that the strings stretch along an elongated neck between the head and the body and over a saddle of a bridge to the string end mounts; and wherein the resilient mounting of the tremolo mount is at least partially decoupled from the tensioned string held by the string mount;

wherein the primary pivotal mount includes a base plate mounted at one end to the upper surface of the body and that overlies a slot in the body wherein pivoting is restricted between the base plate being adjacently planar with the body and pivoting away from the upper surface of the body, the primary pivotal mount further including a stop plate attached to and extending from an underside of the base plate and in use extending into the slot in the body wherein pivoting is resiliently held towards an extended string position by a tension spring mounted between a lower part of the stop plate and a lower part of the body the guitar;

and wherein the string mount includes a pitch lever plate pivotally mounted on the base plate of the tremolo mount with string end mounts for holding the ends of the strings are located on an upper side of the secondary pivotal mount relative to the primary pivotal mount and pitch lever plate in use extending into the slot of the body alongside the stop plate and selectively engageable therewith.

2. The tremolo device for electric guitars according to claim 1, wherein the selectively moveable tremolo mount is by a manual means.

3. The tremolo device for electric guitars according to claim 1, wherein the selectively moveable string mount is by a manual means.

4. The tremolo device for electric guitars according to claim 1, wherein the selectively moveable tremolo mount and the selectively moveable string mount is by a single manual means.

5. The tremolo device for electric guitars according to claim 4, wherein the manual means is a tremolo handle providing leverage on the tremolo device against the resilient mounting and the tensioned strings.

6. The tremolo device for electric guitars according to claim 1, wherein the primary pivotal mount is pivotal on an upper side of the body.

7. The tremolo device for electric guitars according to claim 1, wherein the primary pivotal mount is resiliently held towards an extended string position by a tension spring mounted to a lower part of the body the guitar.

8. The tremolo device for electric guitars according to claim 1, wherein the string end mounts for holding the ends of the strings are located on an upper side of the secondary pivotal mount relative to the pivotal mount on the primary pivotal mount wherein in use the string ends are accessible above the top surface of the body of the guitar without disassembly or access to the slot in the body of the guitar.

9. The tremolo device for electric guitars according to claim 1, wherein: a. the primary pivotal mount is directly held towards an extended string position by a tension spring mounted to a lower part of the body the guitar; b. the primary pivotal mount is indirectly held by a tensioned string position; c. the secondary pivotal mount is indirectly held by a tensioned string position; d. the secondary pivotal mount is indirectly limited towards an extended string position by the tension spring mounted to a lower part of the body the guitar and limited by the interaction of the primary pivotal mount and the secondary pivotal mount and the body of the guitar; e. and wherein the primary pivotal mount and secondary pivotal mount is selectively moveable by the manual means of a tremolo handle providing leverage on the tremolo device against the resilient mounting and the tensioned strings to vary tension of the strings and provide a tremolo effect.

10. The tremolo device for electric guitars according to claim 8, wherein the interaction of the primary pivotal mount and the secondary pivotal mount and the body of the guitar provide limitations of relative pivoting against the resilient mounting of the tremolo mount which is at least partially decoupled from the tensioned string held by the string mount to provide a. Primary pivotal mount pivotable from adjacently parallel to the top surface of the body of the guitar to away from the top surface; b. Secondary pivotal mount pivotable on the primary pivotal mount from a tensioned string position to a less tensioned string position; and c. Secondary pivotal mount pivotable on the primary pivotal mount from a tensioned string position to a more tensioned string position.

11. The tremolo device for electric guitars according to claim 1, wherein selective engagement is by engagement elements formed at a lower level of the stop plate and the pitch lever plate.

12. The tremolo device for electric guitars according to claim 11, wherein the pitch lever plate includes a crank shape which lower level engages with lower level of the stop plate at a resting tensioned spring position.

13. The tremolo device for electric guitars according to claim 12, wherein the pitch lever plate includes a crank shape with a cutaway sized such as to receive the stop plate therethrough and have a lower part of the crank shaped pitch lever plate on one side of the stop plate and the upper part of the crank shaped pitch lever plate including the pivot on the other side of the stop plate wherein rotation caused by the tensioned string is stopped by lower part of the crank shaped pitch lever plate engaging the one side of the stop plate.

14. The tremolo device for electric guitars according to claim 13, wherein the selectively moveable tremolo mount and the selectively moveable string mount is by a single manual means of a tremolo lever mounted to the pitch lever plate of the secondary pivotal mount.

15. The tremolo device for electric guitars according to claim 1, including a string intonation adjustor mounted on the tremolo mount and having a string engaging protuberance for providing a selectively adjustable moveable engagement to the string to fine tune the string intonation.

16. A method of providing a tremolo device for electric guitars including the steps of providing a tremolo device according to claim 1, for limiting the interaction of the primary pivotal mount and the secondary pivotal mount and the body of the guitar wherein the resilient mounting of the tremolo mount is at least partially decoupled from the tensioned string held by the string mount and effectively provides three main differences of operation.

17. The method of providing a tremolo device for electric guitars according to claim 16, wherein a first mode of operation there is the conditions of: a. The tension spring resiliently pivots the base plate to a closed position over the transverse slot; b. The tremolo lever is not activated in a balanced position; and c. The pitch lever plate is in a balanced position; wherein at this point the tension of the strings is in a fixed tunable position similar to a guitar without a tremolo device.

18. The method of providing a tremolo device for electric guitars according to claim 17, wherein at a second mode of operation there is the conditions of: a. The tension spring resiliently pivots the base plate towards a closed position over the transverse slot; b. The tremolo lever is activated in a forward position and pivots the pitch lever plate forward around secondary pivot; and c. The top of the pitch lever plate is moved forward but only till the bottom of the pitch lever plate engages the stop bracket and pivots the base plate open around primary pivot against the resilience of the tension spring; wherein at this point the string end mount is moved forward and the tension of the strings is reduced from the fixed tunable position to provide a variation of pitch and a tremolo effect.

19. The method of providing a tremolo device for electric guitars according to claim 18, wherein at a third mode of operation there is the conditions of: a. The tension spring resiliently pivots the base plate to a closed position over the transverse slot; b. The tremolo lever is activated in a backward position but no longer against any resilience of the tension spring as the base plate has engaged the body on both sides of the transverse slot and can no longer pivot further around primary pivot; and c. The pitch lever plate is in a balanced position, wherein at this point the string end mount is moved backwards and the tension of the strings is increased from the fixed tunable position to provide a variation of pitch and a tremolo effect.

* * * * *